US007789038B2

(12) United States Patent
Sakamoto

(10) Patent No.: US 7,789,038 B2
(45) Date of Patent: Sep. 7, 2010

(54) EJECTION INSPECTION DEVICE, LIQUID DROPLET EJECTION APPARATUS, METHOD OF MANUFACTURING ELECTRO-OPTIC DEVICE, ELECTRO-OPTIC DEVICE, AND ELECTRONIC APPARATUS

(75) Inventor: Kenji Sakamoto, Suwa (JP)

(73) Assignee: Seiko Epson Corporation (JP)

( * ) Notice: Subject to any disclaimer, the term of this patent is extended or adjusted under 35 U.S.C. 154(b) by 640 days.

(21) Appl. No.: 11/708,169

(22) Filed: Feb. 19, 2007

(65) Prior Publication Data

US 2007/0211129 A1 Sep. 13, 2007

(30) Foreign Application Priority Data

Mar. 10, 2006 (JP) ..... 2006-066425

(51) Int. Cl.
*B05C 5/02* (2006.01)

(52) U.S. Cl. ..... 118/663; 118/708; 118/712; 118/300; 118/323; 347/19; 347/23; 347/106

(58) Field of Classification Search ..... 118/663, 118/708, 712, 300, 323; 347/19, 23, 106; 382/112; 399/49
See application file for complete search history.

(56) References Cited

U.S. PATENT DOCUMENTS 5,260,009 A * 11/1993 Penn ..... 264/401
6,386,673 B1 * 5/2002 Takahashi et al. ..... 347/19
6,672,705 B2 1/2004 Kitahara et al.
6,964,468 B2 11/2005 Kitahara et al.

FOREIGN PATENT DOCUMENTS

| | | |
|---|---|---|
| CN | 1497354 | 5/2004 |
| JP | 57-158635 | 3/1981 |
| JP | 2002-103598 | 4/2002 |
| JP | 2003-275649 | 9/2003 |
| JP | 2005-014216 | 1/2005 |

* cited by examiner

*Primary Examiner*—Laura Edwards
(74) *Attorney, Agent, or Firm*—Harness, Dickey & Pierce, P.L.C.

(57) ABSTRACT

An ejection inspection device includes: an inspection stage on which an inspection sheet is sucked and mounted; a sheet feeding mechanism which feeds the inspection sheet wound in a roll form onto the inspection stage; a sheet taking-up mechanism which takes up the fed inspection sheet from the inspection stage; a suction air valve unit which controls the suction air of the inspection stage; a floating air valve unit which controls the floating air of the inspection stage; and a control unit which controls the suction air valve unit, the floating air valve unit, the sheet feeding mechanism, and the sheet taking-up mechanism. The control unit floats the inspection sheet for performing the feeding operation of the inspection sheet and the taking-up operation thereof.

14 Claims, 26 Drawing Sheets

EJECTION INSPECTION DEVICE, LIQUID DROPLET EJECTION APPARATUS, METHOD OF MANUFACTURING ELECTRO-OPTIC DEVICE, ELECTRO-OPTIC DEVICE, AND ELECTRONIC APPARATUS

The entire disclosure of Japanese Patent Application No. 2006-066425, filed Mar. 10, 2006, is expressly incorporated by reference herein.

BACKGROUND

1. Technical Field

The present invention relates to an ejection inspection device for functional liquid droplet ejection heads which eject functional liquid by an ink jet system, a liquid droplet ejection apparatus, a method of manufacturing an electro-optic device, an electro-optic device, and an electronic apparatus.

2. Related Art

Known ejection inspection devices are of a type provided in a liquid droplet ejection apparatus having an imaging device which drives functional liquid droplet ejection heads to eject functional liquid so as to perform an imaging process on a workpiece (such as the glass substrate of a liquid crystal display). Such ejection inspection devices recognize the ejection-result images of the functional liquid droplet ejection heads to thereby inspect ejection failures of the same. Reference is made to JP-A-2005-014216 as an example of related art.

Meanwhile, a possible alternative to the known ejection inspection devices can be developed by using an inspection sheet that is wound into a roll to serve as an inspection workpiece for reduced running costs, etc. and feed the same onto an inspection stage and take it therefrom. Moreover, it is preferable that an ejection inspection be performed with the inspection sheet sucked and mounted on the inspection stage, so as to prevent the inspection workpiece from contacting the nozzle surfaces of the functional liquid droplet ejection heads.

In this case, however, even if the suction is released, there is a possibility of causing the inspection sheet to be tightly sucked on the inspection stage (vacuum suction). Further in this case, the inspection sheet is susceptible to static electricity because it is fed while rubbing against the inspection stage. Therefore, even if the inspection sheet is once separated, it has a possibility of being sucked on the inspection stage due to electrostatic suction. When the inspection sheet is fed in a state of being sucked on the inspection stage, it becomes wrinkled and requires an increased load to be fed and taken up (causing the motor to be overloaded). As a result, it is not possible to feed the inspection sheet adequately. Furthermore, the inspection sheet having static electricity adversely affects the shooting positions of functional liquid in an ejection inspection.

SUMMARY

It is an advantage of the invention to provide an ejection inspection device capable of sucking and mounting an inspection sheet on an inspection stage and feeding the same without increasing its load to be fed and taken up, a liquid droplet ejection apparatus, a method of manufacturing an electro-optic device, an electro-optic device, and an electronic apparatus.

According to a first aspect of the invention, there is provided an ejection inspection device provided in a liquid droplet ejection apparatus having an imaging device which drives a functional liquid droplet ejection head to eject functional liquid so as to perform an imaging process on a workpiece while relatively moving the functional liquid droplet ejection head in the scanning direction to the set workpiece. The ejection inspection device is used to inspect ejection failures of the functional liquid droplet ejection head and comprises: an inspection sheet which is formed in a strip shape and receives an inspecting ejection from the functional liquid droplet ejection head; an inspection stage on which the inspection sheet is sucked and mounted and which communicates with a vacuum suction unit for sucking the inspection sheet and with an air supply unit for floating the inspection sheet; a sheet feeding mechanism which is disposed on one end side of the inspection stage and feeds the inspection sheet wound in a roll form onto the inspection stage; a sheet taking-up mechanism which is disposed on the other end side of the inspection stage and takes up the fed inspection sheet from the inspection stage; a suction air valve unit which is interposed between the inspection stage and the vacuum suction unit and controls the suction air of the inspection stage; a floating air valve unit which is interposed between the inspection stage and the air supply unit and controls the floating air of the inspection stage; and a control unit which controls the suction air valve unit, the floating air valve unit, the sheet feeding mechanism, and the sheet taking-up mechanism. The control unit floats the inspection sheet for performing the feeding operation of the inspection sheet and the taking-up operation thereof.

According to this configuration, the control unit controls the suction air valve unit, the floating air valve unit, the sheet feeding mechanism, and the sheet taking-up mechanism, whereby the inspection sheet is sucked and mounted on the inspection stage by the suction air in an ejection inspection and is fed and taken up in a state in which the suction of the inspection sheet is released and the inspection sheet is floated on the inspection stage by the floating air. Accordingly, the inspection sheet can reliably be separated even if it is sucked on the inspection stage by being sucked and mounted thereon. Furthermore, the inspection sheet has no possibility of rubbing against the inspection stage and is free from static electricity because it is fed in a state of being floated. Accordingly, the inspection sheet is prevented from being fed in a state of being sucked on the inspection stage due to vacuum suction, electrostatic suction, or the like. As a result, it is possible to feed the inspection sheet without increasing its load to be fed and taken up.

Preferably, in this case, the inspection stage includes: a porous plate on which the inspection sheet is sucked and mounted; a frame on which the porous plate is horizontally held; an air chamber which is formed inside the frame facing the bottom surface of the porous plate and communicates with the vacuum suction unit and the air supply unit.

According to this configuration, the porous plate is horizontally held by the frame. Furthermore, the inspection sheet on the porous plate is sucked by the vacuum suction unit through the air chamber. Accordingly, the inspection sheet is horizontally sucked and mounted on the porous plate. In addition, the inspection sheet is uniformly sucked without losing the accuracy of flatness of the suction surface thereof because it is sucked on the porous plate. As a result, it is possible to mount the inspection sheet on the inspection stage horizontally and evenly.

Note that, as a porous plate, there can be employed one constituted of a porous material made of sintered metal (such as stainless steel) and a fluoroplastic subjected to sintering.

Preferably, in this case, the frame and the porous plate are conductive.

According to this configuration, the inspection sheet can more reliably be prevented from being charged with static electricity by making the frame having the inspection sheet mounted thereon and the porous plate conductive.

Preferably, in this case, the sheet feeding mechanism and the sheet taking-up mechanism each have a driving source, and the control unit simultaneously drives the sheet feeding mechanism and the sheet taking-up mechanism to perform the feeding operation and the taking-up operation.

According to this configuration, the inspection sheet can be fed without being given little tension by simultaneously driving the sheet taking-up mechanism and the sheet feeding mechanism. Accordingly, it is possible to further reduce a load to feed and take up the inspection sheet.

Preferably, in this case, the inspection stage is composed of a plurality of divided stages divided into the extending direction of the inspection sheet, the suction air valve unit is configured to be capable of individually controlling the suction air of the plurality of divided stages, and the floating air valve unit is configured to be capable of individually controlling the floating air of the plurality of divided stages.

According to this configuration, it is possible to suck and mount the inspection sheet properly while removing air, for example, by making the plurality of divided stages perform a sucking operation alternately from the divided stage positioned at one end to that positioned at the other end. Furthermore, it is possible to float the inspection sheet smoothly by making the plurality of divided stages perform a floating operation from the divided stage positioned at one end to that positioned at the other end.

Preferably, in this case, the control unit controls the suction air valve unit for sucking the inspection sheet and makes the plurality of divided stages perform a sucking operation alternately from the divided stage positioned at one end to that positioned at the other end.

According to this configuration, it is possible to suck the inspection sheet while removing air alternately from one end. As a result, the inspection sheet can properly be sucked and mounted without becoming wrinkled.

Preferably, in this case, for sucking the inspection sheet, the control unit drives the sheet feeding mechanism slightly in the reverse-feed direction so as to give a tension to the inspection sheet when the sheet feeding mechanism is positioned on the other end side and drives the sheet taking-up mechanism slightly in the forward-feed direction so as to give a tension to the inspection sheet when the sheet taking-up mechanism is positioned on the other end side.

According to this configuration, a sucking operation on the inspection sheet is started with one end while the inspection sheet is given a tension from the other end. Accordingly, it is possible to suck the inspection sheet while removing air more effectively.

Preferably, in this case, the control unit controls the suction air valve unit for sucking the inspection sheet and makes the plurality of divided stages perform a sucking operation alternately from the divided stage positioned at the intermediate part to those positioned at both ends.

According to this configuration, it is possible to suck the inspection sheet while removing air alternately from the intermediate part to both the ends. As a result, the inspection sheet can be sucked and mounted effectively and in a short period of time without becoming wrinkled.

Preferably, in this case, for sucking the inspection sheet, the control unit drives the sheet feeding mechanism slightly in the reverse-feed direction and drives the sheet taking-up mechanism slightly in the forward-feed direction so as to give a tension to the inspection sheet.

According to this configuration, a sucking operation is started with the intermediate part while the inspection sheet is given a tension. Accordingly, it is possible to suck the inspection sheet while removing air more effectively.

Preferably, in this case, a divided air chamber of the respective divided stages is composed of a plurality of segmentalized air chambers, the plurality of segmentalized air chambers are each connected with a suction air passage communicating with the suction air valve unit and a floating air passage communicating with the floating air valve unit, the suction air valve unit is configured to be capable of individually controlling the suction air of the plurality of segmentalized air chambers, and the floating air valve unit is configured to be capable of individually controlling the floating air of the plurality of segmentalized air chambers.

According to this configuration, the suction air valve unit individually controls the suction air of the plurality of segmentalized air chambers and the floating air valve unit individually controls the floating air thereof. Accordingly, the suction air and the floating air for the respective divided porous plates can more finely be controlled. As a result, it is possible to suck and mount the inspection sheet while removing air more effectively by making the plurality of segmentalized air chambers segmentalized into the extending direction of the inspection sheet perform a sucking operation alternately from the segmentalized air chamber positioned at one end to that positioned at the other end. Furthermore, even if there occurs a problem such as valve failure in one of the suction air passage and the floating air passage communicating with the plurality of segmentalized air chambers, the inspection sheet can be sucked and floated by other suction air passages and floating air passages. In other words, it is possible to avoid a situation in which the inspection sheet is not sucked or floated at all in the respective divided stages.

According to a second aspect of the invention, there is provided a liquid droplet ejection apparatus comprising: the ejection inspection device and the imaging device described above.

According to this configuration, the liquid droplet ejection apparatus is provided with the ejection inspection device capable of sucking and mounting the inspection sheet on the inspection stage and of feeding the same without increasing its load to be fed and taken up, to thereby make it possible to inspect ejection failures of the functional liquid droplet ejection heads with the ejection inspection device properly driven.

Preferably, in this case, the imaging device includes a setting table for setting a workpiece and a moving mechanism for moving the workpiece in the scanning direction through the setting table to the functional liquid droplet ejection head, and the ejection inspection device is provided adjacent to the setting table and mounted on the moving mechanism.

According to this configuration, the imaging device performs an imaging operation while making the moving mechanism move the workpiece set on the setting table in the scanning direction to the functional liquid droplet ejection head and thereafter the ejection inspection device adjacent to the setting table is made to face the functional liquid droplet ejection head, so that an ejection inspection is performed. Accordingly, the ejection inspection can be performed immediately after the imaging operation on the workpiece. As a result, it is possible to enhance the manufacturing efficiency.

According to a third aspect of the invention, there is provided a method of manufacturing an electro-optic device, comprising forming a film-deposited portion of functional liquid on the workpiece by the use of the liquid droplet ejection apparatus described above.

According to a fourth aspect of the invention, there is provided an electro-optic device comprising forming a film-deposited portion of functional liquid on the workpiece by the use of the liquid droplet ejection apparatus described above.

According to these configurations, it is possible to manufacture a reliable workpiece efficiently by the liquid droplet ejection apparatus capable of inspecting ejection failures of the functional liquid droplet ejection head with the ejection inspection device properly driven. Examples of electro-optic (flat panel display: FPD) devices include a liquid crystal device, an organic EL (Electro-Luminescence) device, an electron emission device, a PDP (Plasma Display Panel) device, an electrophoresis unit, or the like. Note that the electron emission device refers to a concept including the so-called FED (Field Emission Display) device or SED (Surface-Conduction Electron-Emitter Display) device. Moreover, examples of electro-optic devices include devices for forming metal wiring, lens, resist, light diffuser, or the like.

According to a fifth aspect of the invention, there is provided an electronic apparatus having mounted thereon an electro-optic device manufactured by the method described above, or having mounted thereon the electro-optic device described above.

In this case, an electronic apparatus corresponds to a mobile phone having a so-called flat panel display mounted thereon, a personal computer, various electronic appliances.

BRIEF DESCRIPTION OF THE DRAWINGS

The invention will be described with reference to the accompanying drawings, wherein like numbers reference like elements.

DESCRIPTION OF EXEMPLARY EMBODIMENTS

Referring to the accompanying drawings, a description will be made about an ejection inspection device according to the invention and a liquid droplet ejection apparatus provided therewith. The liquid droplet ejection apparatus is built in the production line of a flat panel display (FDP) such as a liquid crystal display and designed to introduce functional liquid such as special ink and luminescent resin liquid into its functional liquid droplet ejection heads and eject the same therefrom, to thereby form a film-deposited portion of the functional liquid on a substrate such as a color filter.

Figure 1:
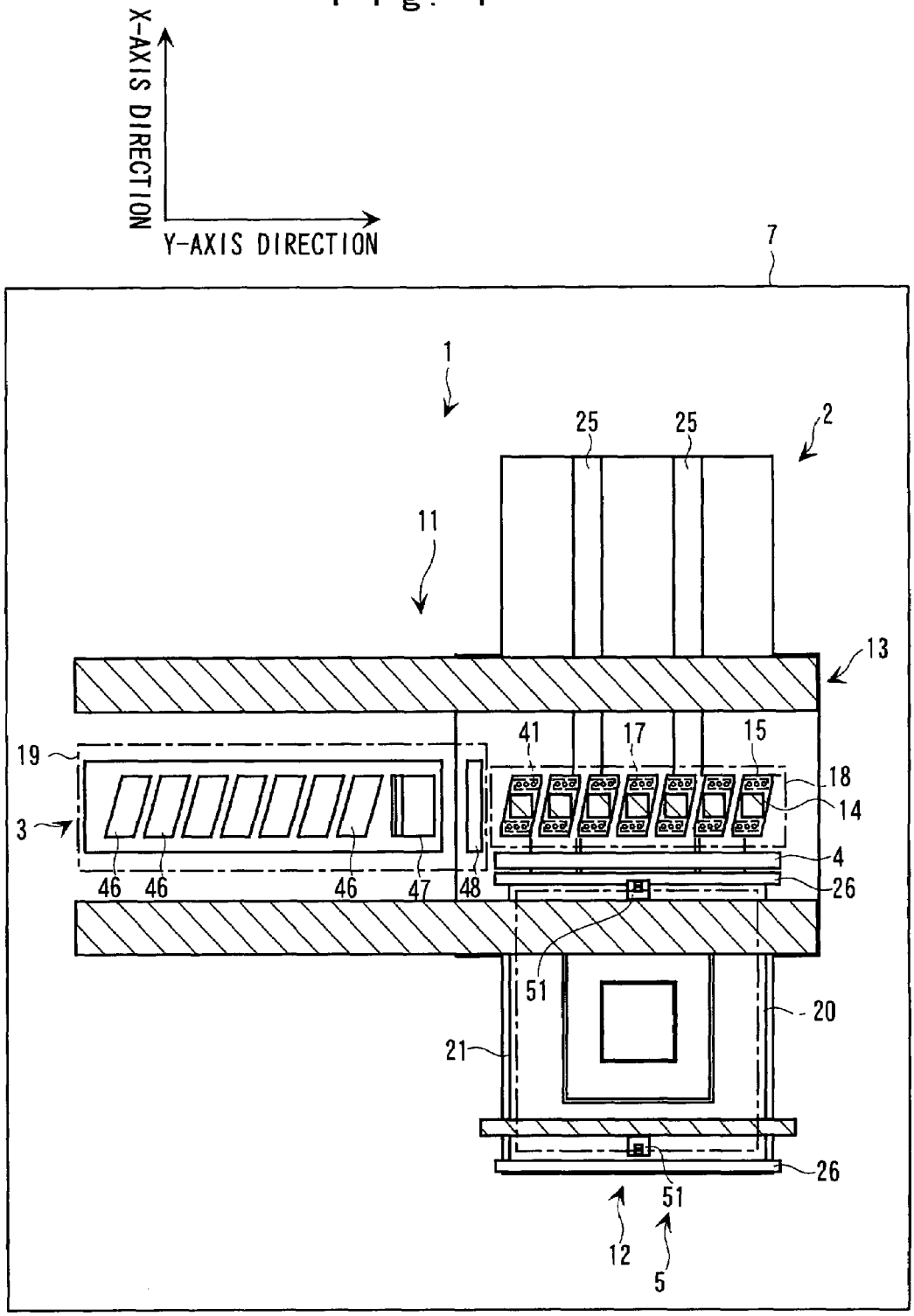
FIG. 1 is a plan view of a liquid droplet ejection apparatus according to embodiments.
Figure 2:
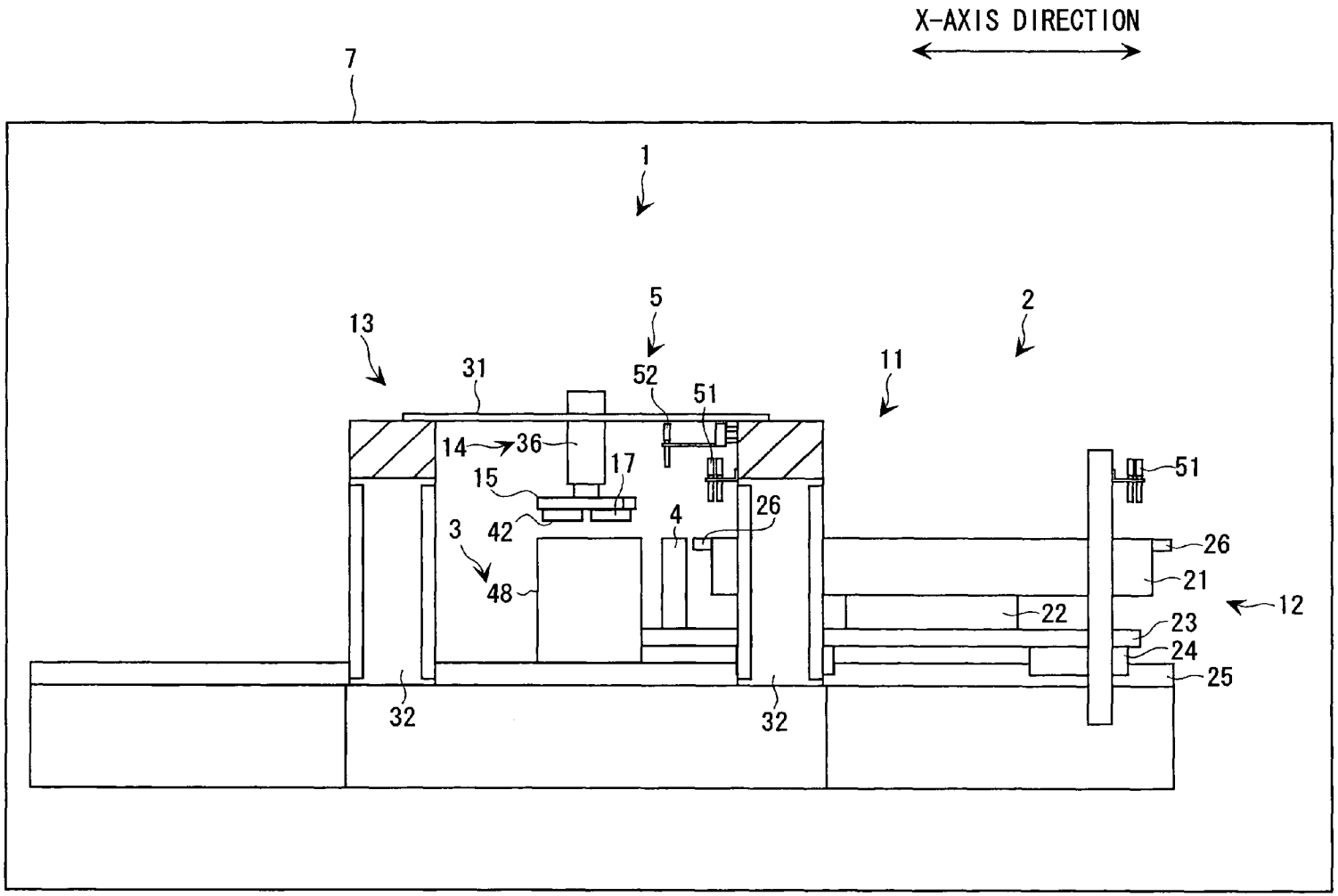
FIG. 2 is a front view of the liquid droplet ejection apparatus according to the embodiments.

As shown in FIGS. 1 and 2, the liquid droplet ejection apparatus 1 includes an imaging device 2 having the functional liquid droplet ejection heads 17 mounted thereon, a maintenance device 3 provided in close proximity to the imaging device 2, and the ejection inspection device 4 which inspects ejection failures of the functional liquid droplet ejection heads 17. Based on inspection results by the ejection inspection device 4, the liquid droplet ejection apparatus 1 makes the maintenance device 3 maintain and recover the function of the functional liquid droplet ejection heads 17 and makes the imaging device 2 perform an imaging process which ejects functional liquid on a substrate W (workpiece). In addition, the liquid droplet ejection apparatus 1 includes an image recognition device 5 having various cameras and a control computer 6 (see FIG. 8) which comprehensively controls the entire devices.

Furthermore, the liquid droplet ejection apparatus 1 is provided in such a manner as to be under clean air. In other words, the liquid droplet ejection apparatus 1 is accommodated in a chamber room 7 to which a clean air supply unit (not shown) provided side by side with the chamber room 7 supplies temperature-controlled clean gas (air).

The imaging device 2 includes: an XY moving mechanism 11 composed of an X-axis table 12 on which the substrate W is mounted and a Y-axis table 13 placed orthogonal to the X-axis table 12; seven carriages 14 movably attached to the Y-axis table 13; and head units 15 provided to suspend in a vertical direction from the respective carriages 14, each having twelve functional liquid droplet ejection heads 17 (only two functional liquid droplet ejection heads shown in FIGS. 1 and 2).

The area, where the moving path of the substrate W by the X-axis table 12 and that of the carriages 14 by the Y-axis table 13 cross each other, serves as an imaging area 18 for performing an imaging process. Furthermore, the area out of the X-axis table 12 on the moving path of the carriages 14 by the Y-axis table 13 serves as a maintenance area 19 where the maintenance device 3 described above is provided. The area on the near side of the X-axis table 12, on the other hand, serves as a substrate feeding area 20 where the substrate W is fed in or fed out from the liquid droplet ejection apparatus 1.

The X-axis table 12 includes: a setting table 21 on which the substrate W fed in the apparatus 1 is sucked to be set; a θ table 22 which corrects the angle of the set substrate W in the θ direction; a mounting base 23 on which the setting table 21 is mounted through the θ table 22; an X-axis air slider 24 which slidably supports the mounting base 23 in the X-axis direction; a pair of right and left X-axis linear motors (not shown) which extend in the X-axis direction and make the substrate W move in the X-axis direction through the setting table 21; and a pair of X-axis guide rails 25 which are provided in parallel with the X-axis linear motors and guide the movement of the X-axis air slider 24. Provided at front and rear portions of the setting table 21 are a pair of flushing boxes 26 which receive the flushing from the respective functional liquid droplet ejection heads 17 before and after an imaging process on the substrate W.

The X-axis table 12 thus configured makes the substrate W set on the setting table 21 reciprocate in the X-axis direction. Note that a motion from the substrate feeding area 20 side to the imaging area 18 side (i.e., motion from the lower side to the upper side in FIG. 1) refers to a forward motion and that from the imaging area 18 side to the substrate feeding area 20 side (i.e., motion from the upper side to the lower side in FIG. 1) refers to a backward motion.

The ejection inspection device 4 as will be described later is provided adjacent to the rear portion of the setting table 21 and mounted on the mounting base 23. Accordingly, the driving of the X-axis table 12 makes the setting table 21 and the ejection inspection device 4 move together in the X-axis direction.

The Y-axis table 13 is mounted on a pair of front and rear columns 32 and includes: seven groups of Y-axis sliders (not shown) which support seven bridge plates 31 at both sides such that the seven bridge plates 31, each having the seven carriages 14 suspending in a vertical direction therefrom, are aligned in the Y-axis direction; a pair of front and rear Y-axis linear motors (not shown) which extend in the Y-axis direction and make the respective bridge plates 31 move in the Y-axis direction through the respective groups of Y-axis sliders; and respective two front and rear Y-axis guide rails (four guide rails in total) (not shown) which extend in the Y-axis direction and guide the movement of the seven bridge plates 31. Accordingly, it is possible to move the seven carriages 14 in the Y-axis direction individually or in a lump sum.

The respective carriages 14 are configured to be driven by a motor driving system and include a head elevating mechanism 36 which lifts up and down the mounted head units 15. The head elevating mechanism 36 allows a work gap (the gap between the nozzle surfaces 42 of the functional liquid droplet ejection heads 17 and the front surface of the substrate W) to be set to a given value (e.g., a value between 0.15 mm and 0.3 mm).

The liquid droplet ejection apparatus 1 has a total of 84 functional liquid droplet ejection heads 17 mounted on the seven carriages 14 (each having 12 ones) and performs an imaging process by the so-called line printing system. In other words, the 84 functional liquid droplet ejection heads 17 range in the Y-axis direction (width direction of the substrate W) and make it possible to perform an imaging process even on an entire area of a large substrate W (1800 mm in width for example) in one ejection scanning.

The respective functional liquid droplet ejection heads 17 are supplied with functional liquid from functional liquid packs or the like (not shown) and eject the functional liquid by an ink jet system (e.g., piezoelectric element driving). Furthermore, the functional liquid droplet ejection heads 17 each include a nozzle surface 42 having a plurality of (e.g., 180) nozzles 41 arranged in lines and eject functional liquid from the respective nozzles 41 when applied with driving waveforms by the head driver (not shown).

The maintenance device 3 includes seven suction units 46 which are disposed in the maintenance area 19 and perform a sucking (cleaning) operation to remove functional liquid of which viscosity is increased in the functional liquid droplet ejection heads 17; a wiping unit 47 which is disposed on the imaging area 18 side of the suction units 46 and wipes off the nozzle surfaces 42 of the functional liquid droplet ejection heads 17; and a flying observation unit 48 which is disposed on the imaging area 18 side of the wiping unit 47 and captures the flying state of the functional liquid ejected from the nozzles 41.

Figure 3:
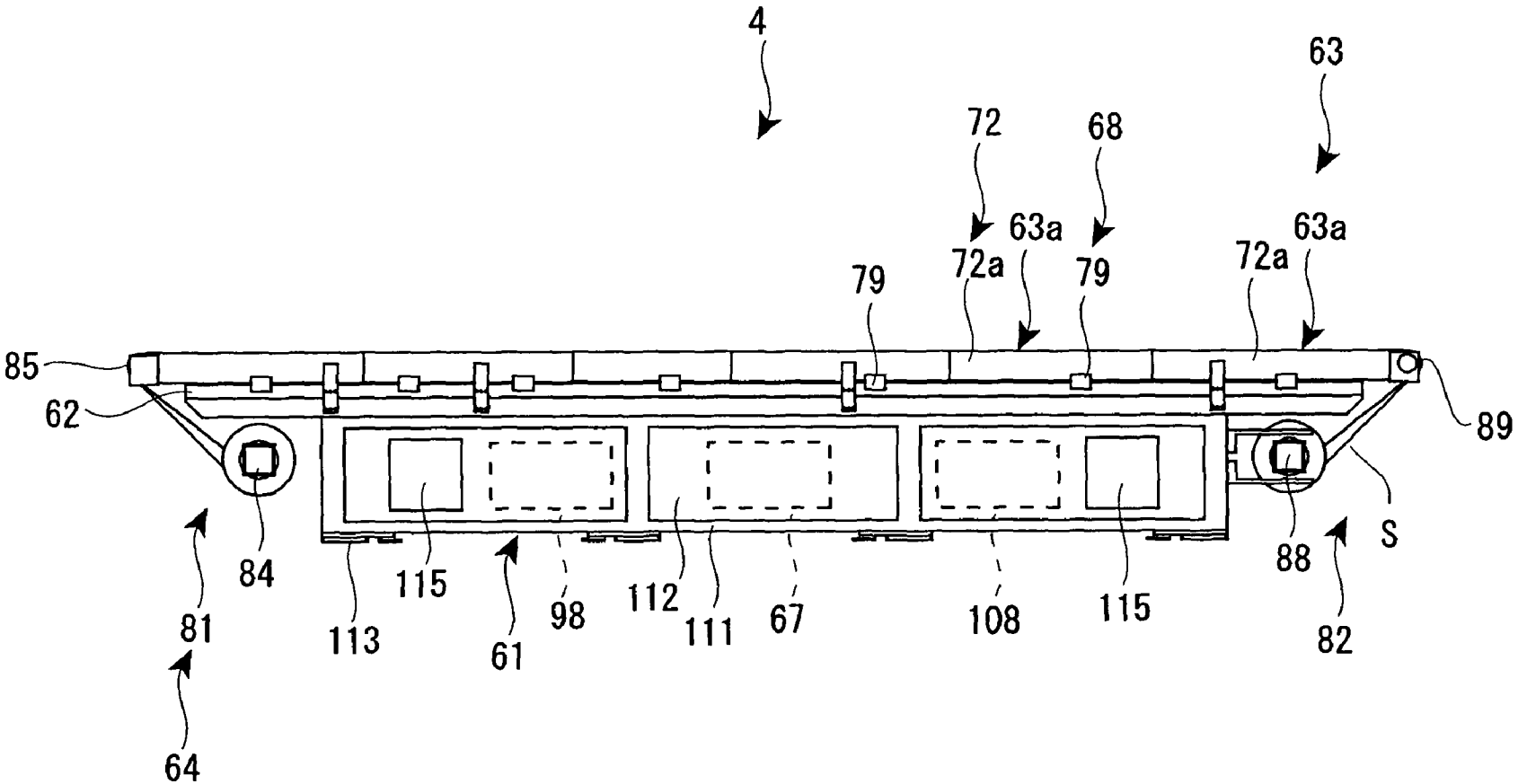
FIG. 3 is a front view of an ejection inspection device according to the embodiments.
Figure 4:
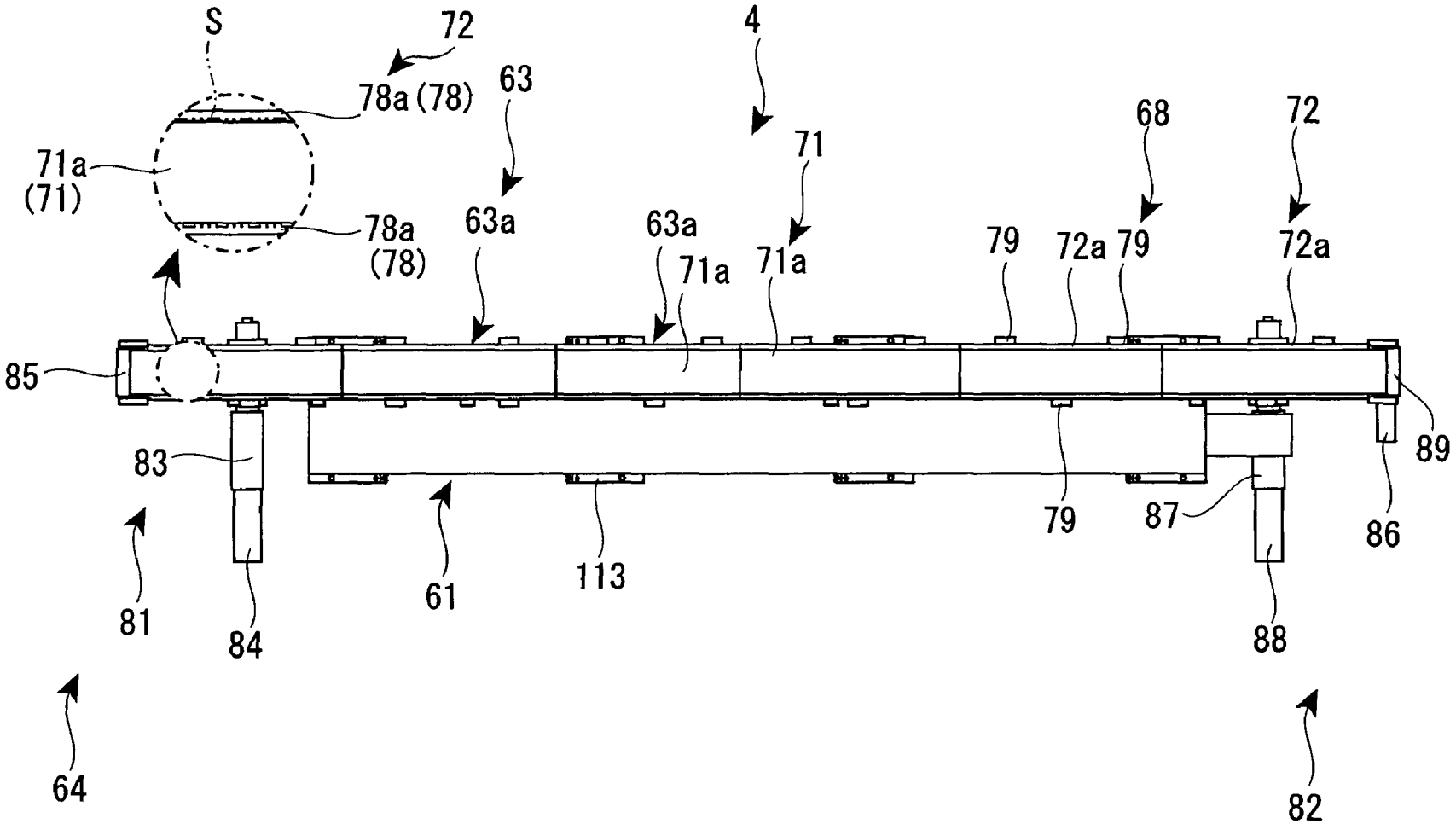
FIG. 4 is a plan view of the ejection inspection device.
Figure 5:
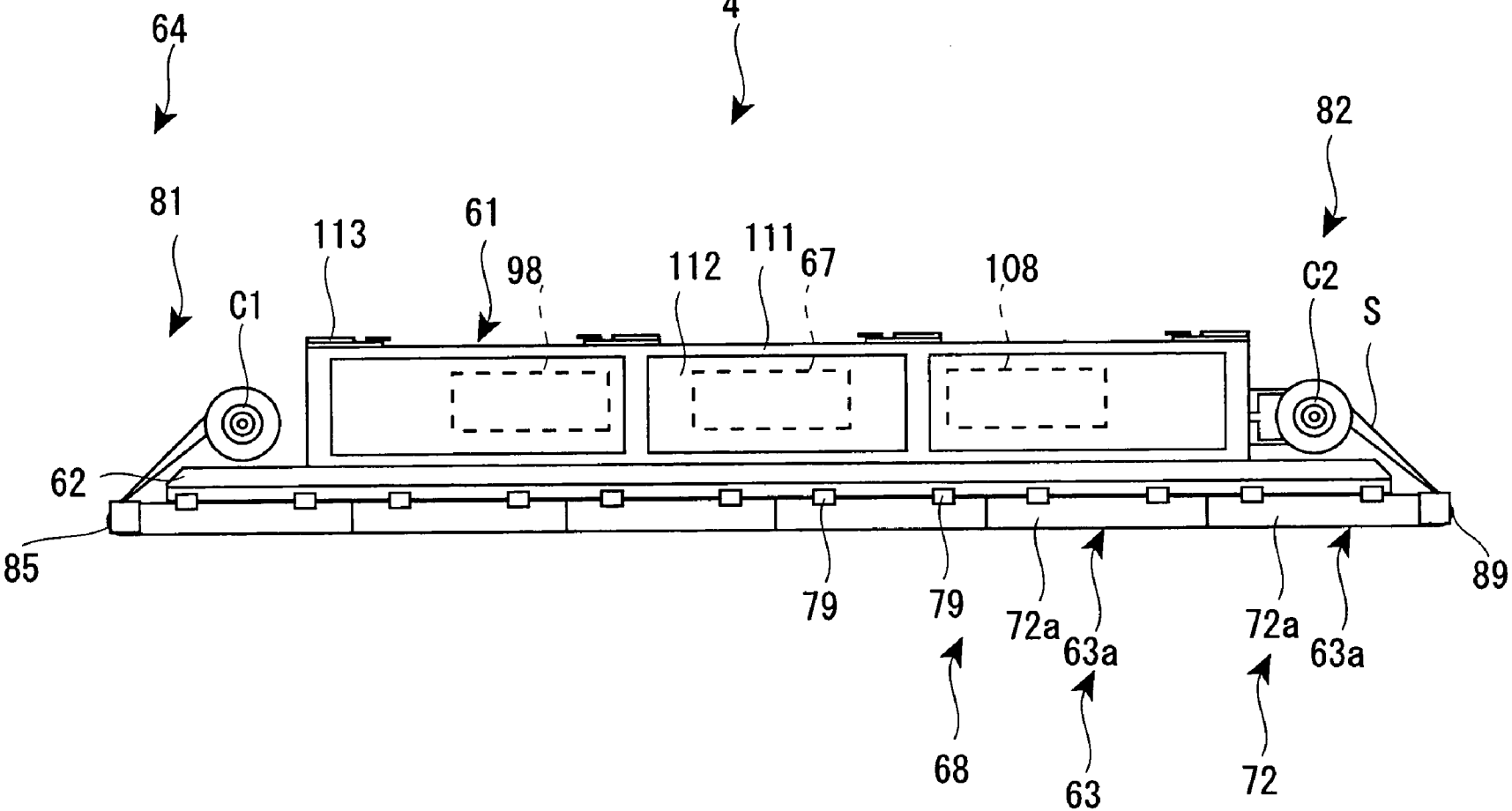
FIG. 5 is a rear view of the ejection inspection device.
Figure 6:
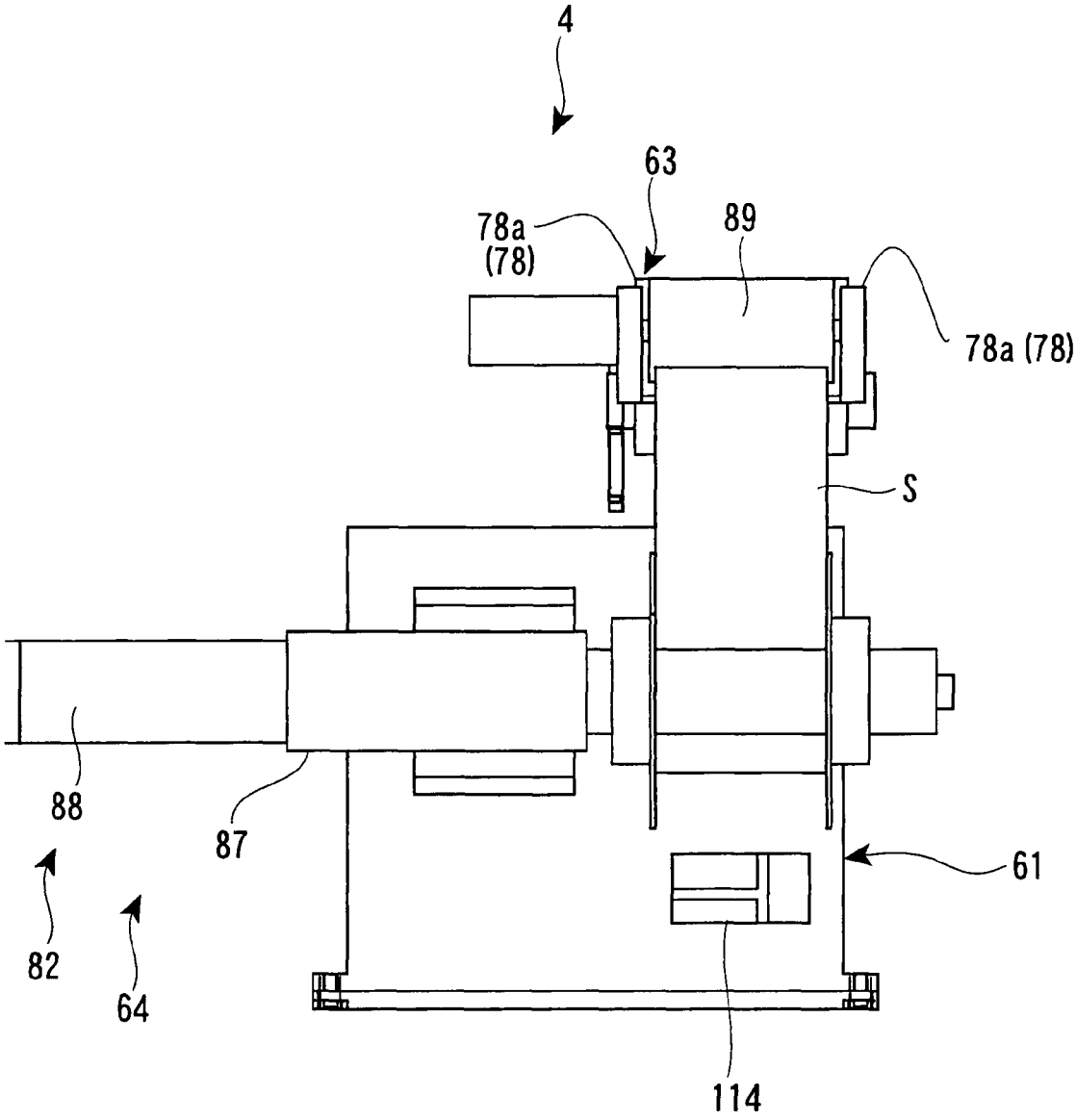
FIG. 6 is a right-side view of the ejection inspection device.

The image recognition device 5 includes: two alignment cameras 51 which are disposed to face both the front and rear sides of the substrate feeding area 20 and recognize the images of two alignment marks (not shown) formed on the substrate W; and an inspection camera 52 which is mounted so as to move in the Y-axis direction with a camera moving mechanism (not shown) provided in close proximity to the Y-axis table 13 and recognizes the images of the functional liquid ejected and shot onto an inspection sheet S (see FIG. 3 or the like) of the ejection inspection device 4.

As described in detail below, the ejection inspection device 4 is disposed on the mounting base 23 and includes an inspection stage 63 whose length corresponds to all the functional liquid droplet ejection heads 17 and the inspection sheet S which is sucked and mounted on the inspection stage 63 and receives an inspecting ejection from the respective functional liquid droplet ejection heads 17. Note that, when an inspecting ejection from the respective functional liquid droplet ejection heads 17 is performed on the inspection sheet S, the gap between the nozzle surfaces 42 of the functional liquid droplet ejection heads 17 and the top surface of the inspection sheet S is set to a slight distance which is almost the same as the work gap described above such that the inspecting ejection is performed under the same condition as an imaging process on the substrate W.

Every ejection inspection, the respective functional liquid droplet ejection heads 17 shift the shooting positions of functional liquid to the width direction (X-axis direction) of the inspecting sheet S and perform an inspecting ejection on the inspection sheet S. When plural times of ejection inspections are performed on the entire width (whole surface) of the inspection sheet S, the inspected part of the inspection sheet S is taken up, and then plural times of ejection inspections are to be performed on the newly fed out non-ejected area of the inspection sheet S in the same manner.

Although not shown in the figures, the control computer 6 is of a personal computer or the like and is connected to the respective devices and includes a computer main body composed of a CPU, a memory, or the like, a keyboard, a display, or the like. As described in detail below, when it is detected that the inspection sheet S of the ejection inspection device 4 fails to be sucked, the message of the suction failure will be displayed (informed) on the display.

Now, a description will briefly be made about a series of imaging processes on the substrate W with the liquid droplet ejection apparatus 1. First, the substrate W is set on the setting table 21 moved to the substrate feeding area 20 and is aligned based on the result of recognizing the images of the alignment marks by the two alignment cameras 51 as a preliminary process before the ejection of functional liquid.

Subsequently, the functional liquid droplet ejection heads 17 are relatively moved in the scanning direction to the substrate W while being driven to eject functional liquid so as to perform an imaging process on the substrate W. In other words, the X-axis table 12 makes the substrate W reciprocate in the X-axis direction while the plurality of functional liquid droplet ejection heads 17 individually eject and shoot functional liquid on the substrate W.

At the final stage of the imaging process, the ejection inspection device 4 backwardly moved together with the setting table 21 by the X-axis table 12 is made to face the plurality of functional liquid droplet ejection heads 17 in such a manner as to follow the setting table 21. After performing the imaging process on the substrate W on the setting table 21, the plurality of functional liquid droplet ejection heads 17 perform an inspecting ejection from all the nozzles 41 on the inspection sheet S of the followed ejection inspection device 4. Accordingly, an ejection inspection can be performed immediately after the imaging process on the substrate W, thereby making it possible to attain enhanced production efficiency.

Next, the result images of ejection are recognized while being scanned with the inspection camera 52 in the Y-axis direction. If no abnormalities such as missing of dots and curved flying are found in the respective nozzles 41, an imaging process will successively be performed on the next substrate W. If found, on the other hand, corresponding functional liquid droplet ejection heads 17 (head units 15) are made to face the maintenance device 3 for a maintenance process before an imaging process is performed.

Referring next to FIGS. 3 to 8, a description will specifically be made about the ejection inspection device 4. The ejection inspection device 4 includes: a dustproof cabinet 61 which is provided on the mounting base 23 and accommodates various electrical units (such as a control unit 67 as will be described later); a base frame 62 mounted on the rear half part on the dustproof cabinet 61; an inspection stage 63 which is supported on the base frame 62 and on which the inspection sheet S is sucked and mounted; and a sheet transferring mechanism 64 which feeds the inspection sheet S onto the inspection stage 63 at one end of the inspection stage 63 and takes up the fed inspection sheet S at the other end thereof.

The ejection inspection device 4 furthermore includes: an air suction mechanism 65 (see FIG. 7) which sucks the inspection sheet S on the inspection stage 63; an air floating mechanism 66 (see FIG. 7) which floats the inspection sheet S on the inspection stage 63; and the control unit 67 which controls respective parts. The ejection inspection device 4 sucks and mounts on the inspection stage 63 the inspection sheet S which receives an inspecting ejection from the functional liquid droplet ejection heads 17 and feeds the same in a floated state. In addition, interposed between the base frame 62 and respective divided stages 63*a* is an inclination adjusting mechanism 68 which can finely adjust the respective divided stages 63*a* so that they are horizontally held.

The inspection sheet S is made of a non-dusting film material and a paper material such as a dustproof paper and formed in a strip shape (having a width of, e.g., 100 mm). The inspection sheet S is attached to a sheet feeding mechanism 81 (as will be described later) of the sheet transferring mechanism 64 with the end on the feeding side of the inspection sheet S wound around a cylindrical feeding core C1 and attached to a sheet taking-up mechanism 82 (as will be described later) with the end on the taking-up side thereof wound around a cylindrical taking-up core C2. The feeding core C1 and the taking-up core C2 are also made of a non-dusting material such as a resin. Accordingly, the generation of dust from the inspection sheet S, the feeding core C1, and the taking-up core C2 can be prevented. Note that it is preferable that the inspection sheet S be formed under a clean condition, packed with cleanliness, and opened up in the chamber room 7, so as to prevent dust from intruding into the inspection sheet S as much as possible.

The inspection stage 63 includes: a porous plate 71 on which the inspection sheet S is sucked and mounted; a frame 72 on which the porous plate 71 is horizontally held; an air chamber 73 (see FIG. 8) which is formed inside the frame 72 facing the bottom surface of the porous plate 71 and communicates with a vacuum suction unit and an air supply unit (not shown) as will be described later.

The inspection stage 63 is composed of six divided stages 63*a* divided into the extending direction (Y-axis direction) of the inspection sheet S. Accordingly, the porous plate 71, the frame 72, and the air chamber 73 are composed of six divided porous plates 71*a* divided into the Y-axis direction, six divided frames 72*a* divided into the Y-axis direction, and six divided air chambers 73*a* divided into Y-axis direction, respectively. In other words, the respective divided stages 63*a* include the divided porous plates 71*a*, the divided frames 72*a*, and the divided air chambers 73*a*.

The inspection stage 63 is composed of the plurality of divided stages 63*a* as described above, thereby making it easier for the inspection stage 63 to be an elongated one (whose length is 1800 mm or more in this embodiment) corresponding to the plurality of functional liquid droplet ejection heads 17.

The respective divided air chambers 73*a* are segmentalized into a plurality of segmentalized air chambers 73*s* by partition walls. In other words, two divided air chambers 73*a* positioned at both ends out of the six divided air chambers 73*a* are each composed of three segmentalized air chambers 73*s* segmentalized into the Y-axis direction, whereas four divided air chambers 73*a* positioned at an intermediate part are each composed of two segmentalized air chambers 73*s* segmentalized into the Y-axis direction. That is, the air chamber 73 of the inspection stage 63 includes 14 segmentalized air chambers 73*s*.

The respective divided porous plates 71*a* are formed in rectangle plates in a plan view and have a width (e.g., 94 mm) which is slightly smaller than that of the inspection sheet S. Furthermore, the respective divided porous plates 71*a* are constituted of a porous material made of sintered metal such as stainless steel and so designed that the mounted inspection sheet S can uniformly be sucked and floated on the respective divided porous plates 71*a* without losing the accuracy of flatness. Note that the respective divided porous plates 71*a* are conductive and make the uppermost layer thereof subjected to a conductive process in case that the porous material constituting the respective divided porous plates 71*a* is made of Teflon® or the like.

The respective divided frames 72*a* are made of a conductive material such as stainless steel and formed in a rectangular box-shape in a plan view whose top surface is opened. Although omitted in the figures, the respective divided frames 72*a* are composed of: peripheral wall portions on which the divided porous plate 71*a* is mounted; a bottom portion to which an air suction tube 91 and an air supply tube 101 as will be described later are connected; and a lattice reinforcing rib which supports the divided porous plate 71*a* mounted on the peripheral wall portions so as not to deflect at a scribing process as will be described later or the like.

At the top ends of the peripheral wall portions on both short sides (short side peripheral wall portions) opposite to the extending direction (Y-axis direction) of the inspection sheet S are mounting portions on which the short side portions of the respective divided porous plates 71*a* are mounted. Accordingly, the adjacent two divided frames 72*a* are mounted so as to be successively ranged in the extending direction of the inspection sheet S with the adjacent divided porous plates 71*a* butted against each other.

Moreover, the adjacent divided porous plates 71*a* are bonded while butted against each other by adhesive. This will prevent suction air from leaking out from the gaps between the adjacent divided porous plates 71*a*. Accordingly, it is possible to suck the inspection sheet S evenly.

On the other hand, formed at the inside areas of the top ends of the peripheral wall portions on both long sides (long side peripheral wall portions 78) opposite to the X-axis direction of the respective divided frames 72*a* are step portions which are lower than the other area of the top ends and on which the respective divided frames 72*a* are mounted. Furthermore, the top end surfaces 78*a* of both the long side peripheral wall portions 78 (both side portions of the respective divided frames 72*a*) are formed to be flush with the top surfaces of the respective divided porous plates 71*a* mounted. For example, when thick divided porous plates 71*a* are mounted, they are trimmed so as to be flush with the top end surfaces 78*a* of both the long side peripheral wall portions 78.

As described above, the top surfaces of the respective divided porous plates 71*a* are formed to be flush with the top end surfaces 78*a* of both the long side peripheral wall portions 78 of the respective frames 72 and the width of the respective divided porous plates 71*a* is formed to be slightly smaller than that of the inspection sheet S. The inspection sheet S is thereby mounted on the respective divided porous plates 71*a* with both end portions thereof in the width direction slightly protruded from the respective divided porous plates 71*a* and put on the top end surfaces 78*a* of both the long side peripheral wall portions 78 of the respective frames 72 (see FIG. 4). Therefore, even if the inspection sheet S is fed while meandering to some extent (about plus or minus 3 mm), it covers the entire surface of the respective divided porous plates 71*a*. Accordingly, it is possible to suck the inspection sheet S without the leakage of suction air efficiently.

The inclination adjusting mechanism 68 is composed of an adjusting screw mechanism 79 interposed at the intermediate position on one side of the respective divided stages 63*a* along the extending direction (Y-axis direction) of the inspection sheet S and composed of two adjusting screw mechanisms 79 interposed at both end positions on the other side thereof.

Although omitted in the figures, the respective adjusting screw mechanisms 79 are composed of a slide block which is fixed at the front or rear surface of the respective divided stages 63*a* and forms an adjusting screw hole (female screw) penetrating in a vertical direction, an adjusting screw screwed into the adjusting screw hole of the slide block, and a fixation block which is fixed at the front or rear surface of the base frame 62 and with which the lower end of the adjusting screw comes in contact. When the adjusting screw is rotated (screwed into or released from) to the slide block, the slide block moves up and down to thereby make it possible for the respective divided stages 63*a* to move up and down relative to the base frame.

Rotating each of the adjusting screws of these three adjusting screw mechanisms 79 as needed allows the inclination angle of the respective divided stages 63*a* to be simply and properly adjusted so that they are horizontally held. The plurality of divided stages 63*a* can be provided on the same plane (horizontal surface) without being inclined to one another, to thereby correctly and horizontally hold the plurality of divided porous plates 71. Accordingly, it is possible to mount the inspection sheet S accurately and horizontally.

The inspection sheet S is uniformly sucked without losing the accuracy of flatness of the suction surface thereof because it is sucked on the porous plate 71. Accordingly, it is possible to mount the inspection sheet S horizontally and evenly on the inspection stage 63.

The sheet transferring mechanism 64 includes the sheet feeding mechanism 81 and the sheet taking-up mechanism 82. The sheet feeding mechanism 81 is disposed on one end side (the left side in the figure) of the inspection stage 63 and feeds the inspection sheet S wound in a roll form onto the inspection stage 63. The sheet taking-up mechanism 82 is disposed on the other end side (the right side in the figure) of the inspection stage 63 and takes up the fed inspection sheet S therefrom.

The sheet feeding mechanism 81 is composed of: a feeding shaft 83 (e.g., air shaft) which is fixed at one side-surface of the dustproof cabinet 61 and into which the feeding core C1 of the inspection sheet S is inserted; a feeding motor 84 (such as servo motor) which is connected to one end of the feeding shaft 83 through a coupling and drives the feeding shaft 83 to feed-rotate; and a feeding guide roller 85 which is rotatably attached to the end of the inspection stage 63 and guides the inspection sheet S fed out from the feeding shaft 83 onto the inspection stage 63. Furthermore, the feeding motor 84 is controlled by a feed speed detector 86 as will be described later. Note that the feeding motor 84 may be controlled along with the detection of the torque thereof.

Similarly, the sheet taking-up mechanism 82 is composed of: a taking-up shaft 87 (e.g., air shaft) which is fixed at the other side-surface of the dustproof cabinet 61 and into which the taking-up core C2 for the inspection sheet is inserted; a taking-up motor 88 (such as servo motor) which is connected to one end of the taking-up shaft 87 through a coupling and drives the taking-up shaft 87 to take-up-rotate; and a taking-up guide roller 89 which is rotatably attached to the end of the inspection stage 63 and guides the inspection sheet S fed onto the inspection stage 63 to the taking-up shaft 87. Furthermore, the taking-up guide roller 89 is provided with the feed speed detector 86 composed of an encoder or the like, to thereby control the taking-up motor 88. In this case also, the taking-up motor 88 can be controlled by the detection of the torque thereof.

With the sheet feeding mechanism 81 and the sheet taking-up mechanism 82 thus configured, the roll inspection sheet S is fed onto the inspection stage 63 and taken up therefrom simultaneously. Therefore, it is possible to use the roll inspection sheet S for an ejection inspection and reduce the replacing frequency of the inspection sheet S. Accordingly, the liquid droplet ejection apparatus 1 can efficiently be operated. Note that the length of the inspection sheet S is preferably long to some extent (e.g., 50 m) so as to reduce the replacing frequency.

As described in detail below, the control unit 67 controls the feeding motor 84 and the taking-up motor 88 in such a manner as to drive them simultaneously. For sucking the inspection sheet S after fed, furthermore, the inspection sheet S is given a tension by driving the sheet feeding mechanism 81 slightly in the reverse-feed direction (reverse rotation of the feeding motor 84) or by driving the sheet taking-up mechanism 82 slightly in the forward-feed direction (forward rotation of the taking-up motor 88).

Although omitted in the figures, provided underneath the taking-up shaft 87 and the feeding shaft 83 is a suction unit composed of an ejector or the like. Even in case of the generation of dust from the inspection sheet S, the suction unit sucks and removes it.

Figure 7:
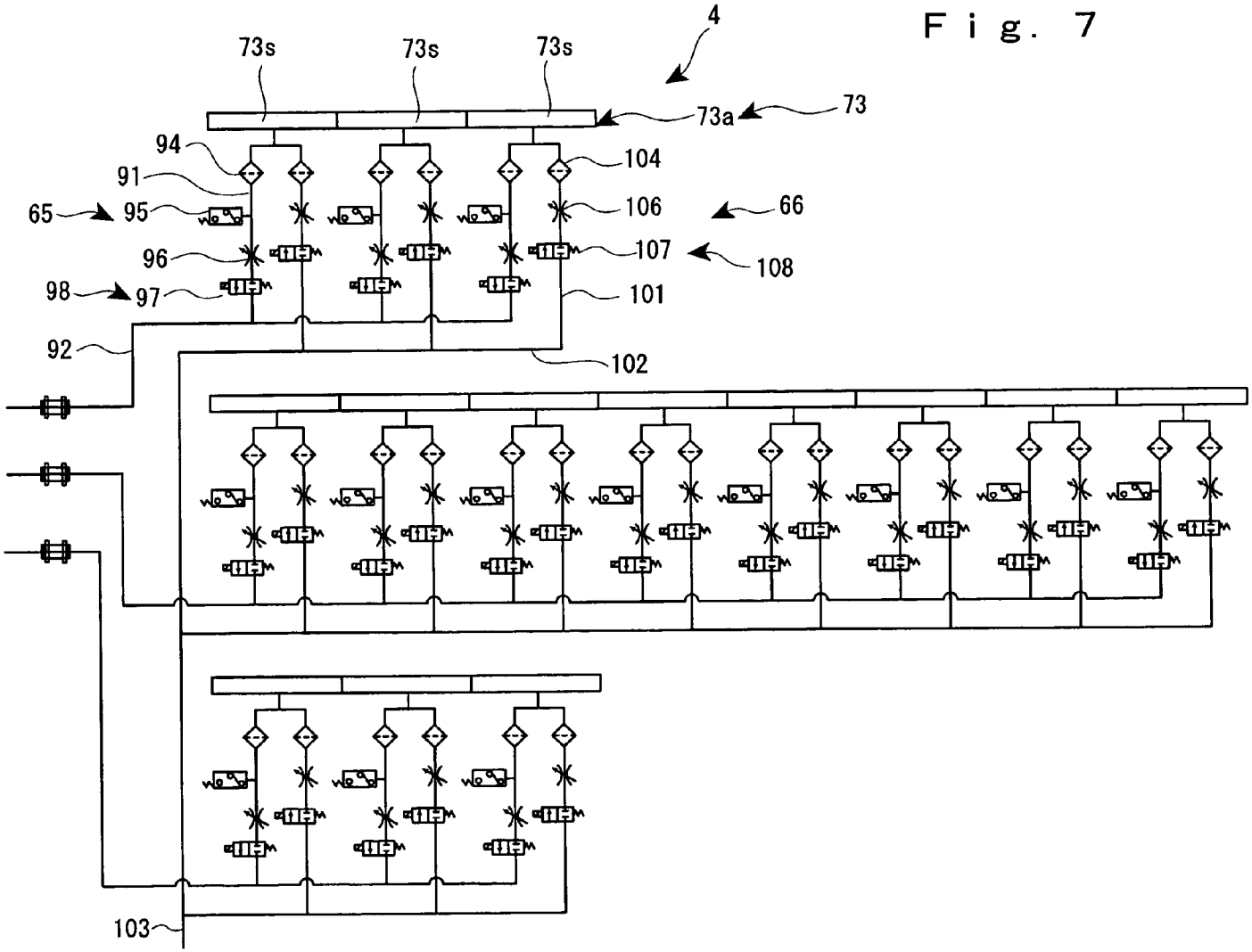
FIG. 7 is a circuit diagram of an air suction mechanism and an air floating mechanism of the ejection inspection device.

As shown in FIGS. 7 and 8, the air suction mechanism 65 is configured to be capable of individually sucking the 14 segmentalized air chambers and includes 14 air suction tubes 91, each connected to a suction port (not shown) formed in the bottom of the respective segmentalized air chambers 73*s* corresponding to the 14 segmentalized air chambers 73*s* and three merging suction tubes 92 comprising three groups of the 14 air suction tubes 91, each of which is merged to one another. The respective merging suction tubes 92 communicates with a vacuum suction unit (not shown) composed of an ejector or the like to which compressed air from a compressed air supply facility (plant facility) is supplied.

The respective air suction tubes 91 have interposed therein a suction filter 94, a vacuum sensor 95 for detecting the pressure in the air chamber, a suction flow regulation valve 96 (throttle valve), and a suction switch valve 97 (electromagnetic switch valve) in the order from the segmentalized air chamber 73*s* side. Controlling the opening and closing of the respective suction switch valves 97 by the control unit 67 individually controls the suction air of the respective segmentalized air chambers 73*s*.

The air suction mechanism 65 has 14 each of the suction filters 94, the vacuum sensors 95, the suction flow regulation valves 96, and the suction switch valves 97 as a whole. These are unitized as a suction filter unit (not shown), a vacuum sensor unit (not shown), a suction flow regulation valve unit (not shown), and a suction valve unit 98 (suction air valve unit) and accommodated in the dustproof cabinet 61 described below.

Similarly, the air floating mechanism 66 is composed of: an upstream-side supply tube 103 connected to the air supply unit (not shown) composed of a regulator or the like which pressure-regulates the compressed air from the compressed air supply facility; three connection supply tubes 102 branched out from the upstream-side supply tube 103; and 14 air supply tubes 101 which are branched out from the respective connection supply tubes 102 and connected to a supply port (not shown) formed in the bottom of the respective segmentalized air chambers 73*s*. The air floating mechanism 66 can individually supply pressure-regulated air to the 14 segmentalized air chambers 73*s*.

The respective air supply tubes 101 have interposed therein a supply filter 104, a supply flow regulation valve 106 (throttle valve), and a supply switch valve 107 (electromagnetic switch valve) in the order from the segmentalized air chamber 73*s* side. Controlling the opening and closing of the respective supply switch valves 107 individually controls the floating air of the respective segmentalized air chambers 73*s*.

The air floating mechanism 66 has 14 each of the supply filters 104, the supply flow regulation valves 106, and the supply switch valves 107 as a whole. These are unitized as a supply filter unit, a supply flow regulation valve unit, and a supply valve unit 108 (floating air valve unit) and accommodated in the dustproof cabinet 61 described below.

Controlling the suction valve unit 98 and the supply valve unit 108 thus configured makes the respective divided stages 63*a* perform sucking and floating operations. In other words, when the respective suction switch valves 97 are "opened" and the respective supply switch valves 107 are "closed" in the respective segmentalized air chambers, suction air is generated in the respective segmentalized air chambers 73*s*, and the respective divided stages 63*a* perform a sucking operation.

At this time, if the inspection sheet S is floated on the divided porous plate 71*a* and the suction air is leaked in the respective divided stages 63*a*, a corresponding vacuum sensor 95 detects a negative pressure smaller than a given one (small absolute value of a negative pressure). In this manner, the respective air suction tubes 91 have the vacuum sensor 95 interposed therein, thereby making it possible to detect the floating of the inspection sheet S due to suction failures easily and reliably.

Then, the detection result is outputted to the control computer 6 through the control unit 67, which displays an alert of the floated inspection sheet S on the corresponding divided stage 63*a*. Accordingly, it is possible to prevent the functional liquid droplet ejection heads 17 from performing an inspecting ejection on the inspection sheet S in a state in which the inspection sheet S is floated due to suction failures and has a possibility of contacting the nozzle surface 42 of the functional liquid droplet ejection heads 17. Of course, the ejection inspection may automatically be stopped.

Note that the floating of the inspection sheet S may be detected by a photosensor composed of a light emitting element provided at one end (e.g., sheet feeding mechanism 81 side) of the inspection stage 63 and composed of a light receiving element provided at the other end (e.g., sheet taking-up mechanism 82 side) thereof.

On the other hand, when the respective suction switch valves 97 are "closed" and the respective supply switch valves 107 are "opened" in the respective segmentalized air chambers, floating air is generated in the respective segmentalized air chambers 73*s*, and the respective divided stages 63*a* perform a floating operation.

The control unit 67 is composed of a circuit board having an element such as a CPU and a memory incorporated therein, a relay circuit, or the like and accommodated in the dustproof cabinet 61 described below. Furthermore, the control unit 67 is connected to the control computer 6 and controls each unit of the ejection inspection device 4 while receiving various instructions from the control computer 6 and outputs the detection result or the like by the vacuum sensor 95 to the control computer 6. Note that controlling the each unit of the ejection inspection device 4 will specifically be described later.

The dustproof cabinet 61 is disposed below the inspection stage 63 and composed of a cabinet frame 111 made of stainless angle fabricated in a lattice shape and a plurality of stainless panels 112 airtightly attached to the cabinet frame 111. Fixed under the dustproof cabinet 61 are plurality of rustproofed installation fittings 113 for installation on the mounting base 23. The dustproof cabinet 61 is thus formed of a rustproofing material such as stainless steel and a material whose front surface is rustproofed. Accordingly, it is possible to prevent the formation of rust in the dustproof cabinet 61 and the generation of dust therefrom.

The dustproof cabinet 61 has accommodated therein various electrical units or the like which may generate dust. For example, the suction valve unit 98, the control unit 67, and the supply valve unit 108 are mounted in the lower part of the dustproof cabinet 61 in the order from the sheet feeding mechanism 81 side. Furthermore, tubes such as the air suction tubes 91 and the air supply tubes 101 are accommodated in the upper part of the dustproof cabinet 61.

Side-surface panels 112 of the dustproof cabinet 61 have formed therein a feeding-side suction port (not shown) facing the sheet feeding mechanism 81 and a taking-up-side suction port 114 facing the sheet taking-up mechanism 82. The feeding-side suction port and the taking-up-side suction port 114 are attached with a metal mesh filter.

Furthermore, front-surface panels 112 of the dustproof cabinet 61 have formed therein a feeding-side exhaust port (not shown) on the sheet feeding mechanism 81 side and a taking-up-side exhaust port (not shown) on the sheet taking-up mechanism 82 side. In addition, fan filter units 115 composed of an exhaust fan and a filter (e.g., ULPA filter) are disposed, facing the respective exhaust ports.

When the fan filter units 115 are driven, the air outside the dustproof cabinet 61 is sucked from the feeding-side suction port and the taking-up-side suction port 114, and the air inside the dustproof cabinet 61 is exhausted from the feeding-side exhaust port and the taking-up-side exhaust port. Accordingly, even if dust is generated from the sheet-feeding mechanism 81 or the sheet taking-up mechanism 82, it can be sucked into the dustproof cabinet 61 from the feeding-side suction port and the taking-up-side suction port 114. The air inside the dustproof cabinet 61 is exhausted from the feeding-side exhaust port and the taking-up-side exhaust port through the filters of the fan filter units 115, thereby preventing the dust of the dustproof cabinet 61 from exhausting in the atmosphere where the units are installed. Furthermore, it is possible to let the heat generated from the control unit 67 or the like escape from the dustproof cabinet 61.

Note that, instead of the fan filter units 115 provided in the feeding-side exhaust port and the taking-up-side exhaust port, an exhaust conduit of which one end communicates with the respective exhaust ports and the other end communicates with an exhaust processing facility (plant facility) may be provided.

Referring now to FIGS. 8A to 8F, a description will be made about a series of operations in which the inspection sheet S is floated and fed by the ejection inspection device 4 and sucked and mounted on the inspection stage 63 thereby. In FIGS. 8A to 8F, only the suction switch valve 97, the supply switch valve 107, and the vacuum sensor 95 which are provided in the segmentalized air chamber 73*s* at the left end of the figure are connected to the control unit 67 for simplification of the drawing. However, actually, all of the suction switch valves 97, the supply switch valves 107, and the vacuum sensors 95 are each connected to the control unit 67 and individually controlled thereby.

Figure 8A:
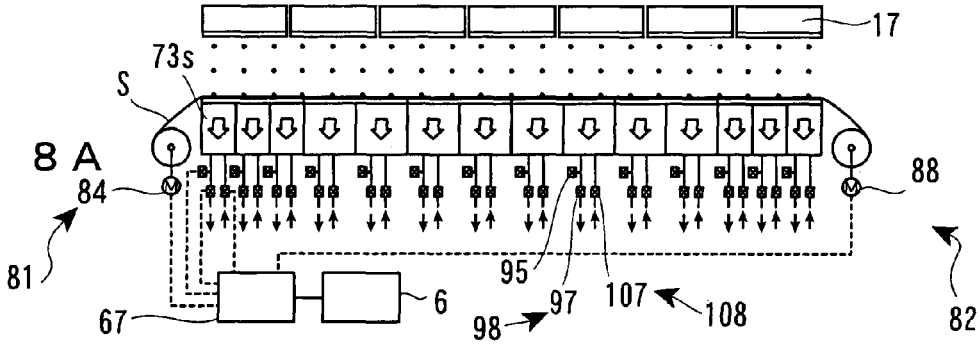
FIGS. 8A to 8F are conceptual diagrams explaining operations in which an inspection sheet is floated and fed by the ejection inspection device and sucked and mounted thereby.

First, an inspecting ejection is performed on the inspection sheet S sucked and mounted on the inspection stage 63 (see FIG. 8A). As described above, the inspection sheet S is horizontally and evenly mounted on the inspection stage 63 at this time. Accordingly, although the gap between the nozzle surfaces 42 of the functional liquid droplet ejection heads 17 and the top surface of the inspection sheet S is set to a slight distance which is almost the same as the work gap (0.15 mm to 0.30 mm) described above, the nozzle surfaces 42 of the functional liquid droplet ejection heads 17 are free from contacting the inspection sheet S when the inspection sheet S is scanned with the functional liquid droplet ejection heads 17.

Figure 8B:
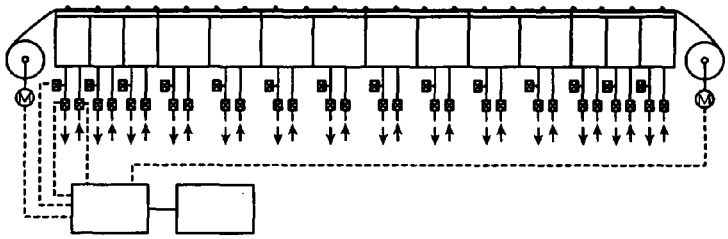

Thereafter, the suction of the inspection sheet S is released before the inspection sheet S is fed (see FIG. 8B). In other words, controlling the suction valve unit 98 makes all the divided stages 63*a* stop a sucking operation.

Figure 8C:
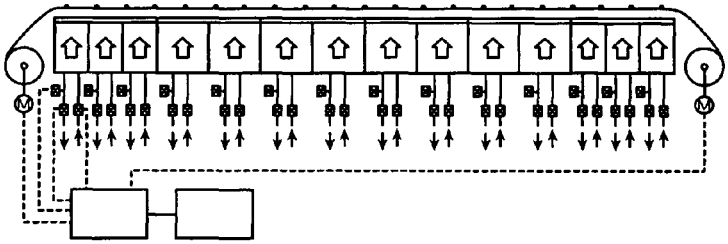

Subsequently, the inspection sheet S is floated (see FIG. 8C). In other words, controlling the supply valve unit 108 makes all the divided stages 63*a* start a floating operation. Accordingly, the inspection sheet S can be separated for sure even when it is not easy to separate the inspection sheet S from the inspection stage 63 because it has been sucked and mounted on the inspection stage 63. Note that, in order to float the inspection sheet S smoothly, floating air may be generated in the 14 segmentalized air chambers 73*s* alternately, for example, from the segmentalized air chamber positioned at the end on the sheet feeding mechanism 81 side to that positioned at the end on the sheet taking-up mechanism 82 side.

Figure 8D:
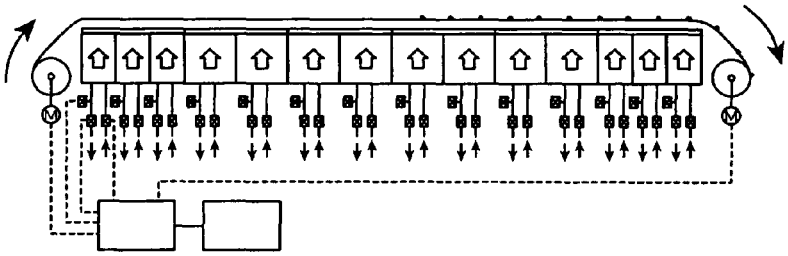
Figure 8E:
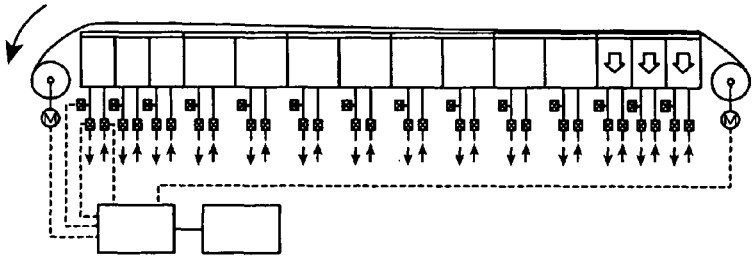

After the inspection sheet S is floated, the sheet feeding mechanism 81 and the sheet taking-up mechanism 82 are simultaneously driven to feed the inspection sheet S until the inspected part thereof is taken up (see FIG. 8D). Therefore, the inspection sheet S has no possibility of rubbing against the inspection stage 63 and is free from static electricity. Accordingly, it is possible to prevent the inspection sheet S from being fed while sucked on the inspection stage 63 due to vacuum suction, electrostatic suction, or the like. As a result, the inspection sheet S does not become wrinkled and require an increased load to be taken up. Furthermore, the shooting positions of functional liquid will not be affected in an ejection inspection because the inspection sheet S is free from static electricity. Note that the respective divided frames 72*a* and the respective divided porous plates 71*a* are conductive as described above, thereby making it possible to more reliably prevent the inspection sheet S from being charged with static electricity.

Moreover, the inspection sheet S is fed in a state of being floated on the inspection stage 63, thereby making it possible for the inspection sheet S to be fed without rubbing against the inspection stage 63. As a result, the generation of dust from the inspection sheet S and the inspection stage 63 can be prevented.

Furthermore, the inspection sheet S can be fed without being given little tension by simultaneously driving the sheet feeding mechanism 81 and the sheet taking-up mechanism 82 and feeding the inspection sheet S. Accordingly, even if the inspection sheet S contacts the inspection stage 63, it does not strongly rub against the inspection stage 63. As a result, the generation of dust from the inspection sheet S and the inspection stage 63 can be prevented. Moreover, a take-up load of the inspection sheet S is reduced, thereby making it possible to prevent the feeding motor 84 and the taking-up motor 88 from being overloaded.

Upon completion of feeding the inspection sheet S, a newly fed-out inspection sheet S is sucked and mounted on the inspection stage 63. At this time, suction air is generated in the 14 segmentalized air chambers 73*s* alternately from the segmentalized air chamber positioned at the end on the sheet taking-up mechanism 82 side to that positioned at the end on the sheet feeding mechanism 81 side in a state in which the inspection sheet S is given a tension with the sheet feeding mechanism 81 driven slightly in the reverse-feed direction (see FIG. 8E). Accordingly, it is possible to suck the inspection sheet S while removing air alternately from the end on the sheet taking-up mechanism 82 side. As a result, the inspection sheet S can properly be sucked and mounted without becoming wrinkled.

At this time, it is possible only to generate the suction air alternately from the segmentalized air chamber positioned at the end on the sheet taking-up mechanism 82 side to that positioned at the end on the sheet feeding mechanism 81 side without giving a tension to the inspection sheet S. Note, however, that giving a tension to the inspection sheet S from the sheet feeding mechanism 81 side as in this embodiment makes it possible to suck the inspection sheet S while the air is more effectively removed.

It is furthermore possible to generate the suction air in the 14 segmentalized air chambers 73*s* alternately from the segmentalized air chamber positioned at the end on the sheet feeding mechanism 81 side to that positioned at the end on the sheet taking-up mechanism 82 side in a state in which the inspection sheet S is given a tension with the sheet taking-up mechanism 82 driven slightly in the forward-feed direction. Moreover, in order to suck and mount the inspection sheet S in a short period of time, it is also possible to generate the suction air in the 14 segmentalized air chambers 73*s* alternately from the segmentalized air chamber positioned at the intermediate part to those positioned at both the ends on the sheet feeding mechanism 81 and the sheet taking-up mechanism 82 sides in a state in which the inspection sheet S is given a tension from both the ends thereof with the sheet feeding mechanism 81 driven slightly in the reverse-feed direction and the sheet taking-up mechanism 82 driven slightly in the forward-feed direction.

Figure 8F:
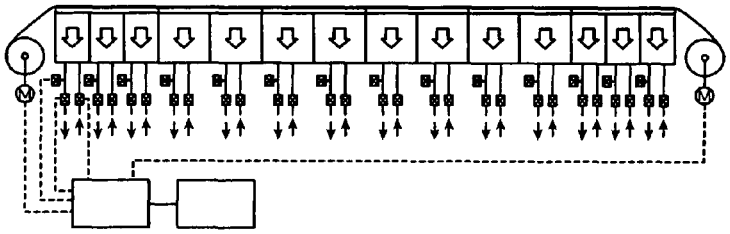

When the suction air is generated up to the segmentalized air chamber 73*s* at the end on the sheet feeding mechanism 81 side, the newly fed-out inspection sheet S is sucked and mounted on the inspection stage 63 in whole (see FIG. 8F). In this manner, the series of operations in which the inspection sheet S is floated and fed by the ejection inspection device 4 and sucked and mounted on the inspection stage 63 thereby are completed.

Although the suction air and the floating air are controlled on a segmentalized air chamber 73*s* basis in this embodiment, they may be controlled on a divided air chamber 73*a* (divided stage 63*a*) basis. Note, however, that controlling on a segmentalized air chamber 73*s* basis makes it possible to control the suction air and the floating air more finely with respect to the respective divided porous plates 71*a* and perform the above-described removal of the air more properly when the inspection sheet S is sucked and mounted, or the like.

As described above, the liquid droplet ejection apparatus 1 of this embodiment is provided with the ejection inspection device 4 capable of horizontally and evenly mounting the inspection sheet S, to thereby make it possible to inspect ejection failures of the functional liquid droplet ejection heads 17 without causing the inspection sheet S to contact the nozzle surfaces 42 of the functional liquid droplet ejection heads 17. Furthermore, the liquid droplet ejection apparatus 1 is provided with the ejection inspection device 4 capable of feeding the inspection sheet S onto the inspection stage 63 and of sucking and mounting the same thereonto without increasing dust in the atmosphere where the units are installed, to thereby make it possible to perform an imaging process on the substrate W under clean air without causing dust intruded into the atmosphere. In addition, the liquid droplet ejection apparatus 1 is provided with the ejection inspection device 4 capable of sucking and mounting the inspection sheet S on the inspection stage 63 and feeding the same without increasing its load to be fed and taken up, to thereby make it possible to inspect ejection failures of the functional liquid droplet ejection heads 17 with the ejection inspection device properly driven.

Next, a description will be made about a construction and a method of manufacturing, for example, a color filter, a liquid-crystal display (LCD), an organic EL (electro-luminescence) device, a plasma display panel (PDP device), an electron emission device (FED (field emission display) and SED (surface-conduction electron-emitter display)), and an active matrix substrate which is formed in the aforementioned display devices, as an electro-optic device (flat panel display) manufactured by the use of the liquid droplet ejection apparatus 1 of this embodiment. Note that the active matrix substrate refers to a substrate having a thin film transistor, a source line electrically connected to the thin film transistor, and a data line formed therein.

Figure 9:
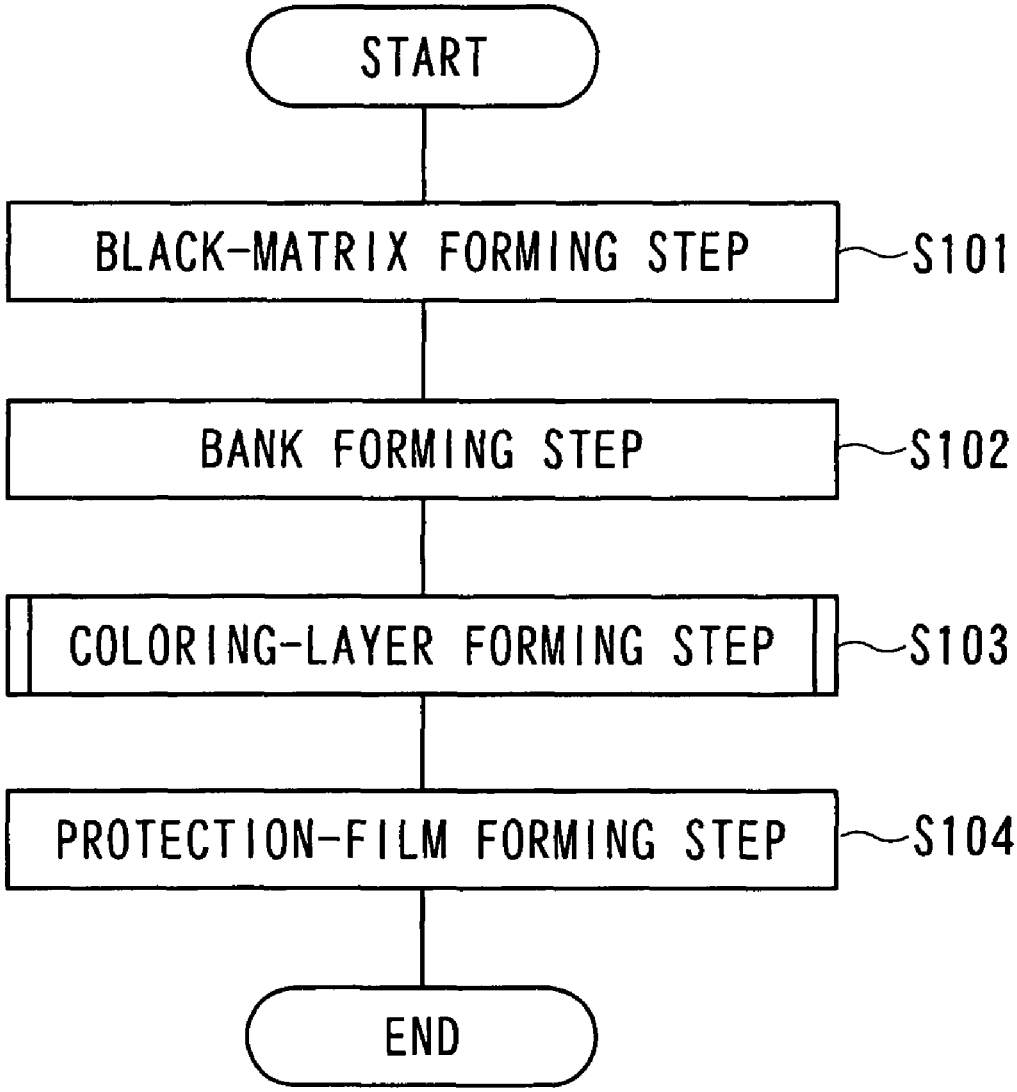
FIG. 9 is a flow chart explaining a step of manufacturing a color filter.

To begin with, a description will be made about a method of manufacturing a color filter to be incorporated in a liquid-crystal display device, an organic EL device, or the like. FIG. 9 is a flow chart showing a process of manufacturing a color filter, and FIGS. 10A to 10E are a schematic cross section of a color filter 500 (filter substrate 500A) of this embodiment as shown in the order of the manufacturing process thereof.

Figure 10A:
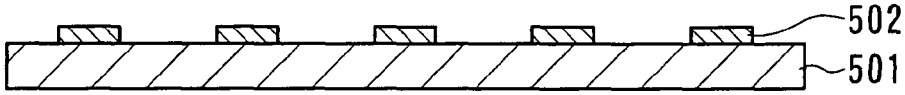
FIGS. 10A to 10E are schematic cross sections of the color filter as shown in the order of manufacturing the same.

First, in a black-matrix forming step (S101), a black matrix 502 is formed on a substrate (W) as shown in FIG. 10A. The black matrix 502 is made of a chromium metal, a laminated body of a chromium metal and a chromium oxide, a resin black, or the like. A sputtering method, a vapor deposition method, or the like can be used to form the black matrix 502 made of a metallic thin film. Furthermore, a gravure printing method, a photo-resist method, a thermal transfer method, or the like can be used to form the black matrix 502 made of a resin thin film.

Figure 10B:
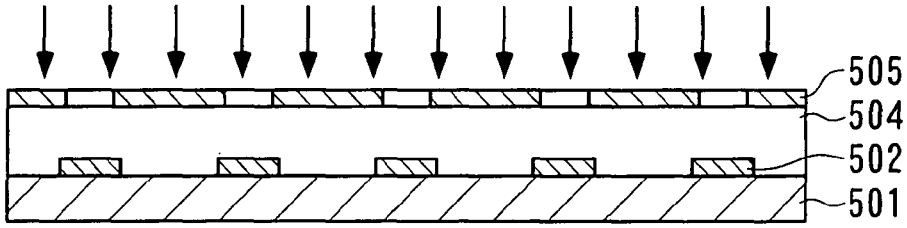

Subsequently, in a bank forming step (S102), a bank 503 is formed so as to superpose on the black matrix 502. In other words, as shown in FIG. 10B, a resist layer 504 made of a negative transparent photosensitive resin is formed to cover the substrate 501 and the black matrix 502. Then, an exposure process is performed on the top surface of the resist layer in a state of being covered by a mask film 505 formed in a matrix pattern.

Figure 10C:
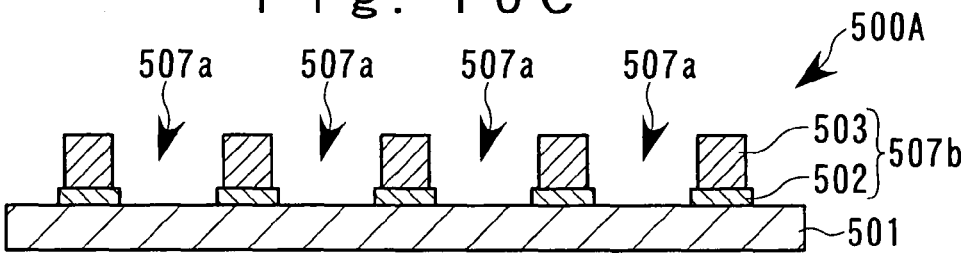

Moreover, as shown in FIG. 10C, an unexposed portion of the resist layer 504 is etched to pattern the resist layer 504, thereby forming the bank 503. Note that, when the black matrix is formed of a resin black, it is possible that the black matrix serves also as the bank.

The bank 503 and the black matrix 502 thereunder serve as a partition wall portion 507*b* for partitioning respective pixel regions 507*a* and define shooting positions of functional liquid droplets when coloring layers (film-deposited portions) 508R, 508G, and 508B are formed with the functional liquid droplet ejection heads 17 in a coloring-layer forming step as described later.

According to the black-matrix forming step and the bank forming step as described above, the filter substrate 500A can be obtained.

Note that, in this embodiment, a resin material is used as a material of the bank 503 so as to have a lyophobic (hydrophobic) surface of a coating film. The front surface of the substrate (glass substrate) 501 is lyophilic (hydrophilic), thereby automatically compensating variations in position of liquid droplets shot into the respective pixel regions 507*a* surrounded by the banks 503 (partition wall portions 507*b*) in a coloring-layer forming step as described later.

Figure 10D:
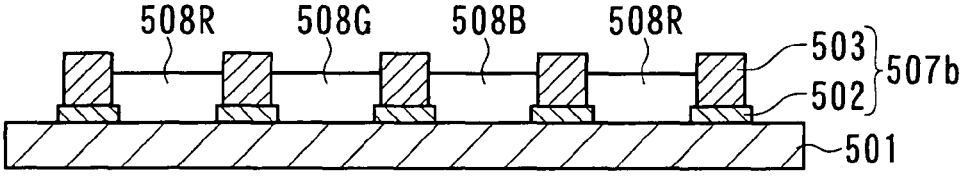

Next, in the coloring-layer forming step (S103), functional liquid droplets are ejected by the functional liquid droplet ejection heads 17 and shot into the respective pixel regions 507*a* surrounded by the partition wall portions 507*b* as shown in FIG. 10D. In this case, a functional liquid (filter material) of three colors of R (red), G (green), and B (blue) is introduced by the functional liquid droplet ejection heads 17 to eject functional liquid droplets. Note that examples of arrangement patterns for the three colors of R, G, and B include a strip arrangement, a mosaic arrangement, a delta arrangement, or the like.

Figure 10E:
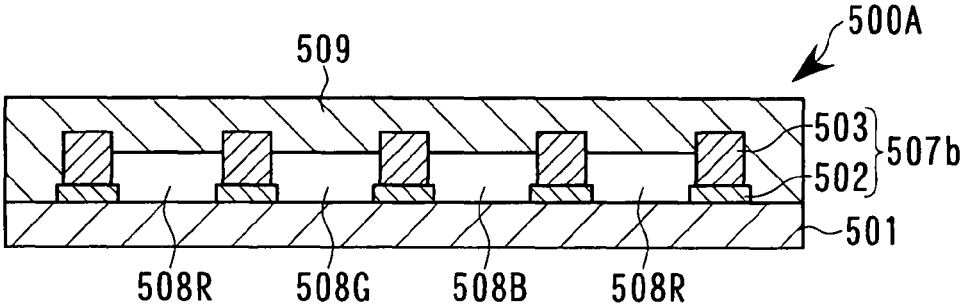

Subsequently, the functional liquids are subjected to drying treatment (e.g., thermal treatment) so as to be fixed, and the coloring layers 508R, 508G, and 508B of the three colors are formed. After the coloring layers of 508R, 508G, and 508B are formed, the step is moved to a protection-film forming step (S104) where a protection film 509 is formed to cover the top surfaces of the substrate 501, the partition wall portions 507*b*, and the coloring layers 508R, 508G, and 508B as shown in FIG. 10E.

In other words, after a coating liquid for a protection film is ejected on the whole surface of the substrate 501 having the coloring layers 508R, 508G, 508B formed thereon, the whole surface is subjected to drying treatment to thereby form the protection film 509.

After the protection film 509 is formed, the step is moved to the next step of forming ITO (Indium Tin Oxide) as a transparent electrode in manufacturing the color filter 500.

Figure 11:
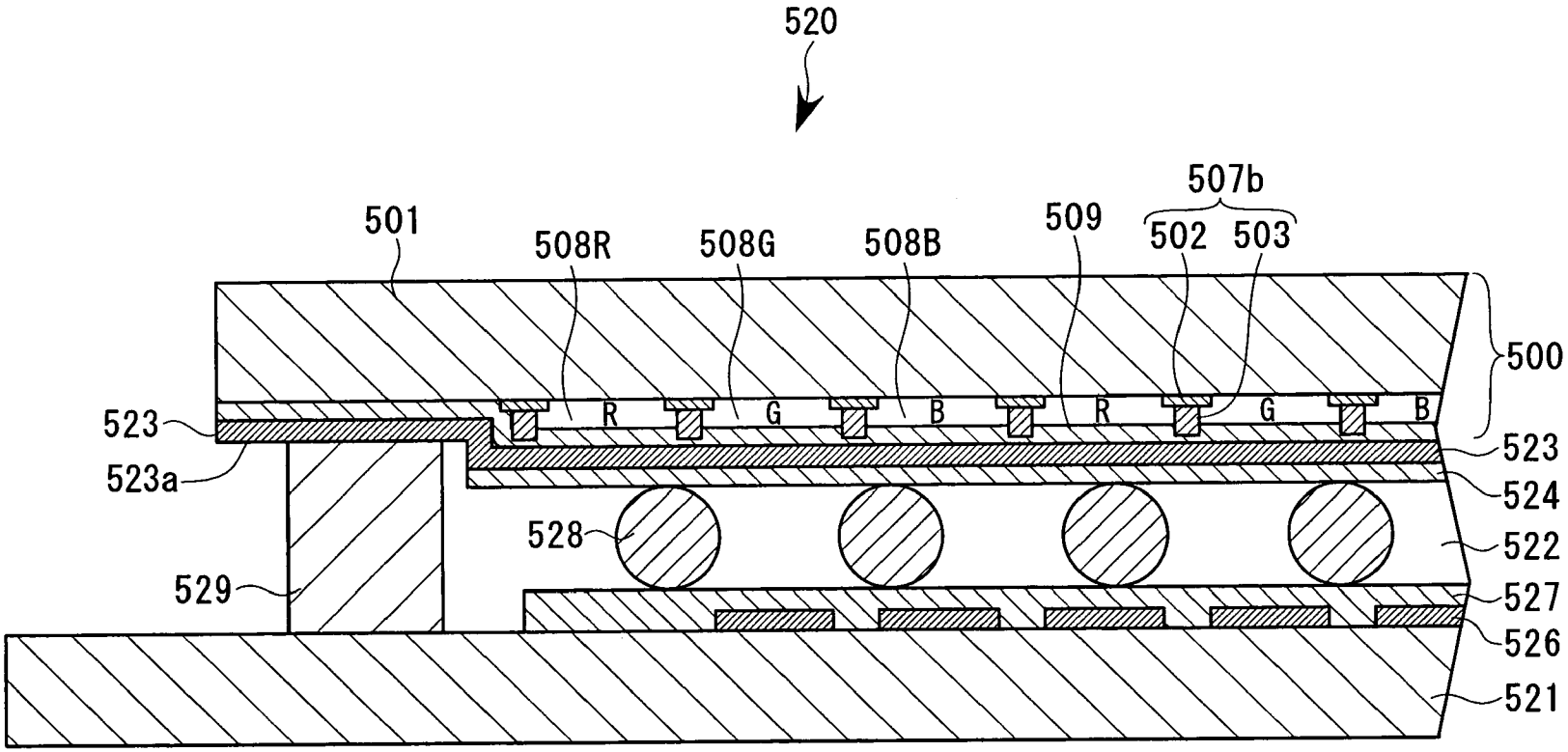
FIG. 11 is a cross section of an essential part showing a schematic configuration of a liquid crystal device using the color filter to which the invention is applied.

FIG. 11 is a cross section of an essential part showing a schematic configuration of a passive matrix liquid crystal display (liquid crystal device) as an example of an LCD using the color filter 500 as described above. It is made possible to obtain a transmission liquid crystal display as a final product by mounting additional elements such as a liquid crystal driving IC, a backlight, a supporting body on a liquid crystal device 520. Note that this color filter 500 is identical with that shown in FIGS. 10A to 10E. Thus, the corresponding portions are denoted by the same reference numerals, but the description thereof will be omitted.

The liquid display device 520 is roughly composed of the color filter 500, a counter substrate 521 made of a glass substrate or the like, and a liquid crystal layer 522 which is made of an STN (Super Twisted Nematic) liquid crystal composition and held between the color filter and the counter substrate. The color filter 500 is arranged on the upper side of the figure (on the observer's side).

Note that, although not shown in the figure, polarizers are each disposed on the outside surfaces of the counter substrate 521 and the color filter 500 (the surfaces opposite to the liquid crystal layer 522 side), and the backlight is disposed on the outside of the polarizer arranged on the counter substrate 521 side.

On the protection film 509 of the color filter 500 (liquid crystal layer side), a plurality of elongated first electrodes 523 in a strip shape are formed in the longitudinal direction at predetermined intervals as shown in FIG. 11. A first alignment layer 524 is formed to cover the surfaces opposite to the color filter 500 side of the first electrodes 523.

On the other hand, on the surface of the counter substrate 521 opposite to the color filter 500, a plurality of elongated second electrodes 526 in a strip shape are formed in the direction orthogonal to the first electrodes 523 of the color filter 500 at predetermined intervals. A second alignment layer 527 is formed to cover the surfaces of the liquid crystal layer 522 side of the second electrodes 526. The first electrodes 523 and the second electrodes 526 are made of a transparent conductive material such as ITO.

Spacers 528 provided in the liquid crystal layer 522 are members for holding a constant thickness (cell gap) of the liquid crystal layer 522. Furthermore, a sealant 529 is a member for preventing a liquid crystal composition of the liquid crystal layer 522 from leaking outside. Note that one end portion of each of the first electrode 523 extends to the outside of the sealant 529 as a routing wire 523*a*.

Areas where the first electrodes 523 and the second electrodes 526 cross each other are pixels at which the coloring layers 508R, 508G, and 508B of the color filter 500 are to be positioned.

According to the conventional manufacturing process, the color filter 500 side is formed in such a way that the first electrodes 523 are patterned and the first alignment layer 524 is coated on the color filter 500, while the counter substrate 521 side is formed in such a way that the second electrodes 526 are patterned and the second alignment layer 527 is coated on the counter substrate 521. Subsequently, the spacers 528 and the sealant 529 are formed on the counter substrate 521 side and bonded to the color filter 500 side. Next, after liquid crystal constituting the liquid crystal layer 522 is filled in from an inlet of the sealant 529, the inlet is closed. Then, both polarizers and the backlight are deposited.

According to the liquid droplet ejection apparatus 1 of the embodiment, it is, for example, possible to coat a spacer material (functional liquid) constituting the cell gap and evenly coat liquid crystal (functional liquid) in the region surrounded by the sealant 529 before the color filter 500 side is bonded to the counter substrate 521 side. It is further possible to perform printing of the sealant 529 with the functional liquid droplet ejection heads 17. In addition, it is possible to coat the first and second alignment layers 524 and 527 with the functional liquid droplet ejection heads 17.

Figure 12:
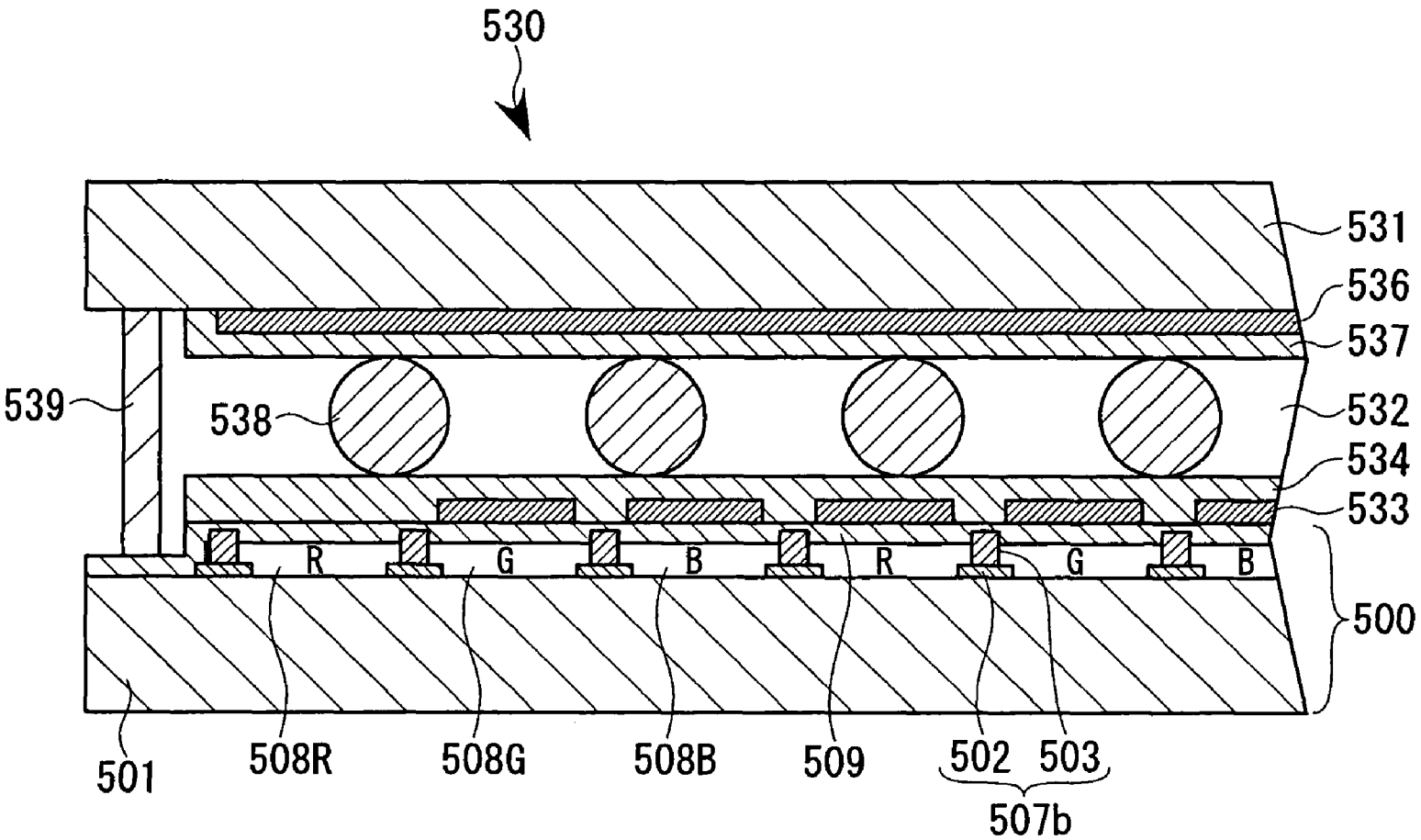
FIG. 12 is a cross section of an essential part showing a schematic configuration of a liquid crystal device as a second example using the color filter to which the invention is applied.

FIG. 12 is a cross section of an essential part showing a schematic configuration of a liquid crystal device, as a second example, using the color filter 500 manufactured in this embodiment.

The liquid crystal device 530 is greatly different from the liquid crystal device 520 in that the color filter 500 is arranged on the lower side of the figure (the side opposite to the observer's side).

The liquid display device 530 is roughly composed of the color filter 500, a counter substrate 531 made of a glass substrate or the like, and a liquid crystal layer 532 made of an STN liquid crystal composition and held between the color filter and the counter substrate. Note that, although not shown in the figure, polarizers or the like are each disposed on the outside surfaces of the counter substrate 531 and the color filter 500.

On the protection film 509 of the color filter 500 (liquid crystal layer 532 side), a plurality of elongated first electrodes 533 in a strip shape extending in the direction orthogonal to the figure are formed at predetermined intervals. A first alignment layer 534 is formed to cover the surfaces on the liquid crystal layer 532 side of the first electrodes 533.

On the surface of the counter substrate 531 opposite to the color filter 500, a plurality of elongated second electrodes 536 in a strip shape extending in the direction orthogonal to the first electrodes 533 on the color filter 500 side are formed at predetermined intervals. A second alignment layer 537 is formed to cover the surfaces of the liquid crystal layer 532 side of the second electrodes 526.

The liquid crystal layer 532 has provided therein spacers 538 for holding a constant thickness of the liquid crystal layer 532 and a sealant 539 for preventing a liquid crystal composition in the liquid crystal layer 532 from leaking outside.

In the same manner as that of the liquid crystal device 520, areas where the first electrodes 533 and the second electrodes 536 cross each other are pixels at which the coloring layers 508R, 508G, and 508B of the color filter 500 are to be positioned.

Figure 13:
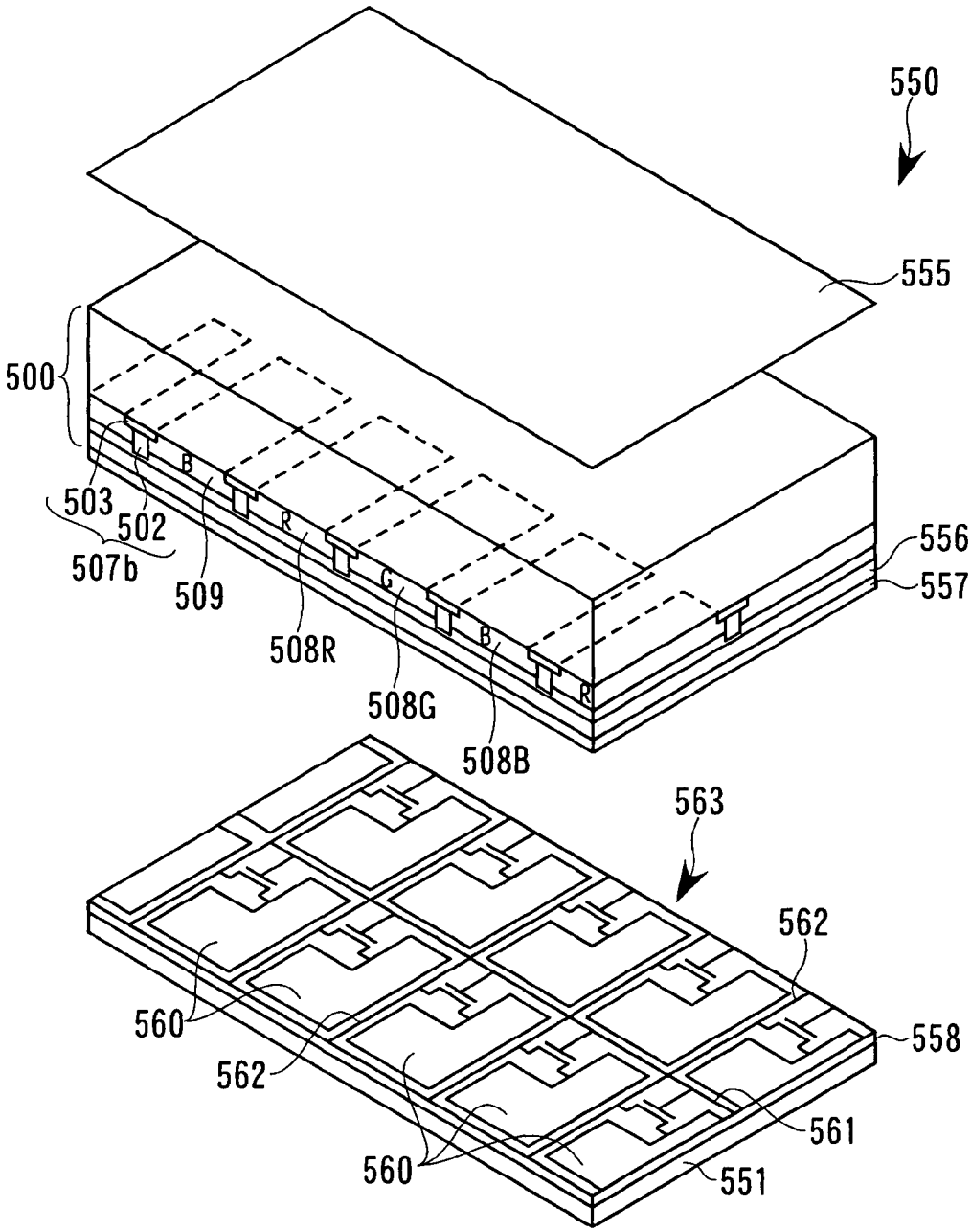
FIG. 13 is a cross section of an essential part showing a schematic configuration of a liquid crystal device as a third example using the color filter to which the invention is applied.

FIG. 13 shows a third example in which a liquid crystal device is constituted by the use of the color filter 500 to which the invention is applied and is an exploded perspective view showing a schematic configuration of a transmission TFT (Thin Film Transistor) liquid crystal device.

In the liquid crystal device 550, the color filter 500 is arranged on the upper side of the figure (on the observer's side).

The liquid crystal device 550 is roughly composed of the color filter 500, a counter substrate 551 disposed so as to oppose the color filter, a liquid crystal layer held between the color filter and the counter substrate (not shown), a polarizer 555 disposed on the top surface side of the color filter 500

(observer's side), and a polarizer (not shown) disposed on the bottom surface side of the counter substrate 551.

On the front surface of the protection film 509 of the color filter 500 (the surface on the counter substrate 551 side) is formed electrodes 556 for driving liquid crystal. The electrodes 556 are made of a transparent conductive material such as ITO and serves as the whole electrode covering the whole region in which the later-mentioned pixel electrodes 560 are formed. Furthermore, an alignment layer 557 is disposed in such a way as to cover the surfaces of the electrodes 556 opposite to the pixel electrodes 560 side.

The counter substrate 551 has an insulating layer 558 formed on the surface thereof opposite to the color filter 500. On the insulating layer 558 are formed scanning lines 561 and signal lines 562 in such a way that they directly cross each other. In regions surrounded by the scanning lines 561 and the signal lines 562 are formed pixel electrodes 560. Note that, although an alignment layer is disposed on the pixel electrodes 560 in an actual liquid crystal devices, it is omitted in the figure.

Furthermore, in the portion surrounded by a notch of the pixel electrode 560, each of the scanning lines 561, and each of the signal lines 562 is incorporated a thin film transistor 563 including a source electrode, a drain electrode, a semiconductor, and a gate electrode. It is possible, by applying signals to the scanning lines 561 and the signal lines 562, to turn on or off the thin film transistor 563 so as to perform an energizing control on the pixel electrodes 560.

Note that, although the liquid crystal devices 520, 530, and 550 of the respective examples as described above are of a transmission type, it is also possible to employ a liquid crystal device of a reflective type or a semi-transparent reflective type by providing a reflective layer or a semi-transparent reflective layer therein.

Figure 14:
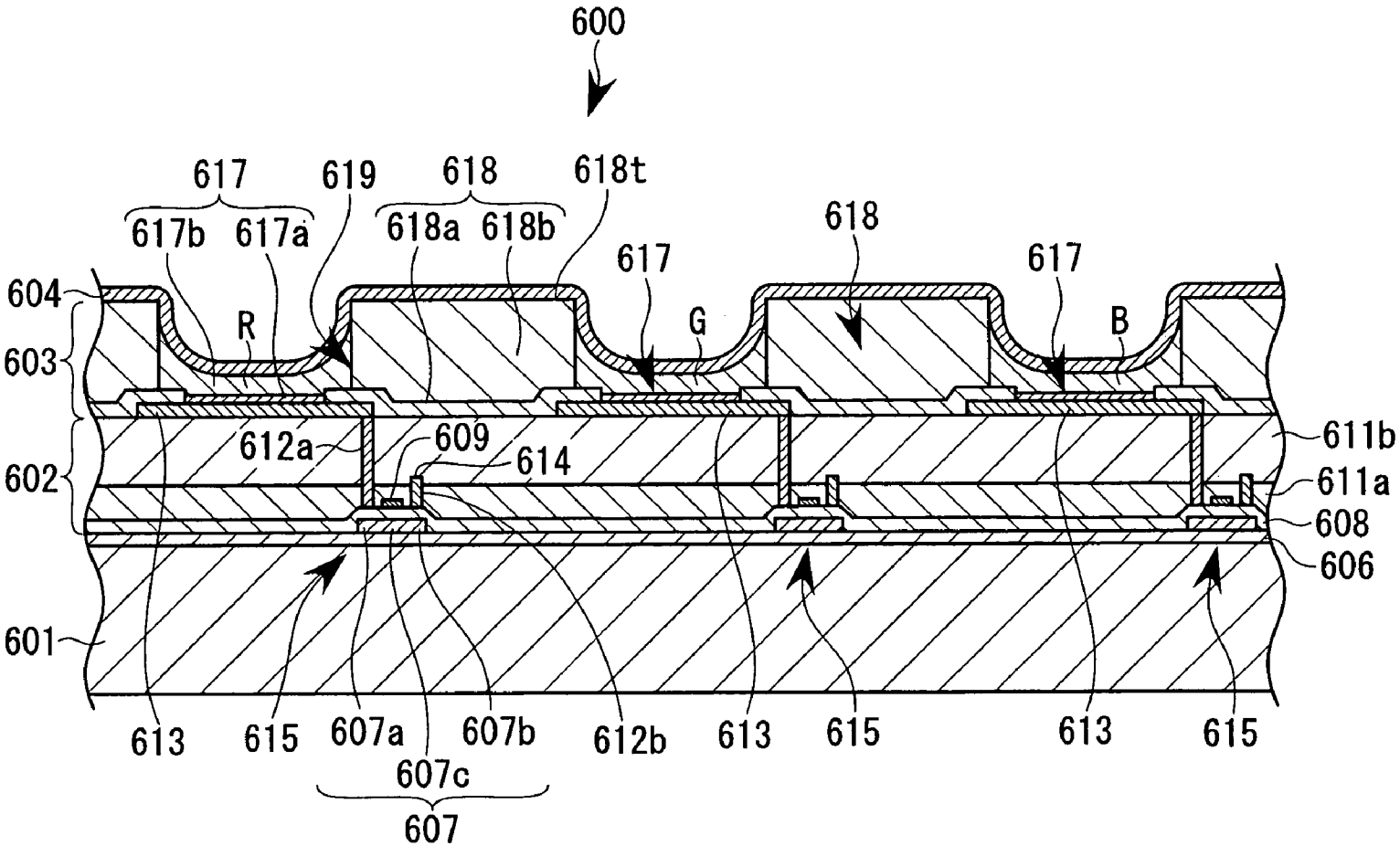
FIG. 14 is a cross section of an essential part of a display device as an organic EL device.

Next, FIG. 14 is a cross section of an essential part of a display region of an organic EL device (hereinafter, simply referred to as a display device 600).

The display device 600 has a rough configuration in which a circuit element portion 602, a light-emitting element portion 603, and a cathode 604 are laminated on a substrate (W) 601.

In the display device 600, light emitted from the light-emitting element portion 603 to the substrate 601 side passes through the circuit element portion 602 and the substrate 601 and is emitted to the observer's side, while light emitted from the light-emitting element portion 603 to the side opposite to the substrate 601 is reflected by the cathode 604, then passes through the circuit element portion 602 and the substrate 601, and is emitted to the observer's side.

The circuit element portion 602 and the substrate 601 have a base protection film 606 made of a silicone oxide film formed therebetween. The base protection film 606 (light-emitting element portion 603 side) has island-shaped semiconductor films 607 made of polycrystalline silicone formed thereon. In the left and right regions of the semiconductor films 607, highly concentrated cations are implanted so as to form a source region 607*a* and a drain region 607*b*, respectively. The central portion where no cations are implanted serves as a channel region 607*c*.

Furthermore, the circuit element portion 602 has a transparent gate insulation film 608 covering the base protection film 606 and the semiconductor film 607 formed thereon. At the positions corresponding to the channel regions 607*c* of the semiconductor film 607 on the gate insulation film 608 are formed gate electrodes 609 constituted of Al, Mo, Ta, Ti, W, or the like. The gate electrodes 609 and the gate insulation film 608 have first and second transparent interlayer insulation films 611*a* and 611*b* formed thereon. Furthermore, contact holes 612*a* and 612*b* are formed in such a way as to penetrate the first and second interlayer insulation films 611*a* and 611*b* and communicate with the source region 607*a* and the drain region 607*b* of the semiconductor film 607, respectively.

The second interlayer insulation film 611*b* has transparent pixel electrodes 613 made of ITO or the like formed thereon in a predetermined pattern, and each of the pixel electrodes 613 is connected to the source region 607*a* via the contact hole 612*a*.

Furthermore, the first interlayer insulation film 611*a* has a power source line 614 disposed thereon. The power source line 614 is connected to the drain region 607*b* via the contact hole 612*b*.

As described above, the circuit element portion 602 has driving thin film transistors 615 connected to the respective pixel electrodes 613 formed therein.

The light-emitting element portion 603 is roughly constituted of functional layers 617 laminated on a plurality of pixel electrodes 613 and bank portions 618 which are provided between sets of the respective pixel electrodes 613 and the functional layers 617 so as to partition the respective functional layers 617.

A light-emitting element is composed of the pixel electrodes 613, the functional layers 617, and the cathode 604 disposed on the functional layers 617. Note that the pixel electrodes 613 are patterned in a substantially rectangular shape in plan view, and the bank portions 618 are formed between the respective pixel electrodes 613.

Each of the bank portions 618 is composed of an inorganic bank layer 618*a* (first bank layer) made of an inorganic material such as SiO, $SiO_2$, or $TiO_2$ and an organic bank layer 618*b* (second bank layer) laminated on the inorganic bank layer 618*a* and is made of a resist such as an acryl resin resist or a polyimide resin resist excellent in thermal resistance and solvent resistance, having a trapezoidal shape in cross section. A part of the bank portion 618 overlies the periphery of the respective pixel electrodes 613.

The respective bank portions 618 have an opening portion 619 formed therebetween, formed to be gradually enlarged upward relative to the pixel electrodes 613.

Each of the functional layers 617 is composed of a hole-injecting/transporting layer 617*a* and a light-emitting layer 617*b* formed on the hole-injecting/transporting layer 617*a*, both lying on the pixel electrode 613 of the opening portion 619 in a laminated state. Note that another functional layer having any other function may be additionally formed, lying adjacent to the light-emitting layer 617*b*. For example, it is possible to form an electron-transporting layer.

The hole-injecting/transporting layer 617*a* serves to transport holes from the pixel electrode 613 side and inject the same into the light-emitting layer 617*b*. The hole-injecting/transporting layer 617*a* is formed after a first composition (functional liquid) containing a material for forming a hole-injecting/transporting layer is ejected. A publicly known material is used as the material for forming a hole-injecting/transporting layer.

The light-emitting layer 617*b* emits light of any one of the colors red (R), green (G), and blue (B) and is formed after a second composition (functional liquid) containing a material for forming a light-emitting layer (light-emitting material) is ejected. It is preferable that a publicly known material insoluble to the hole-injecting/transporting layer 617*a* be used as a solvent of the second composition (nonpolar solvent). Such a nonpolar solvent is used as the second composition of the light-emitting layer 617*b*, thereby making it possible to form the light-emitting layer 617*b* without dissolving the hole-injecting/transporting layer 617*a* again.

According to this configuration, holes injected from the hole-injecting/transporting layer 617*a* and electrons injected from the cathode 614 are reunited so as to emit light in the light-emitting layer 617*b*.

The cathode 604 is formed so as to cover the whole light-emitting element portion 603 and plays an role of passing an electric current to the functional layer 617 together with the pixel electrode 613 as a pair. Note that the cathode 604 has a sealing member (not shown) arranged thereabove.

Referring next to FIGS. 15 to 23, a description will be made about a process of manufacturing the display device 600.

Figure 15:
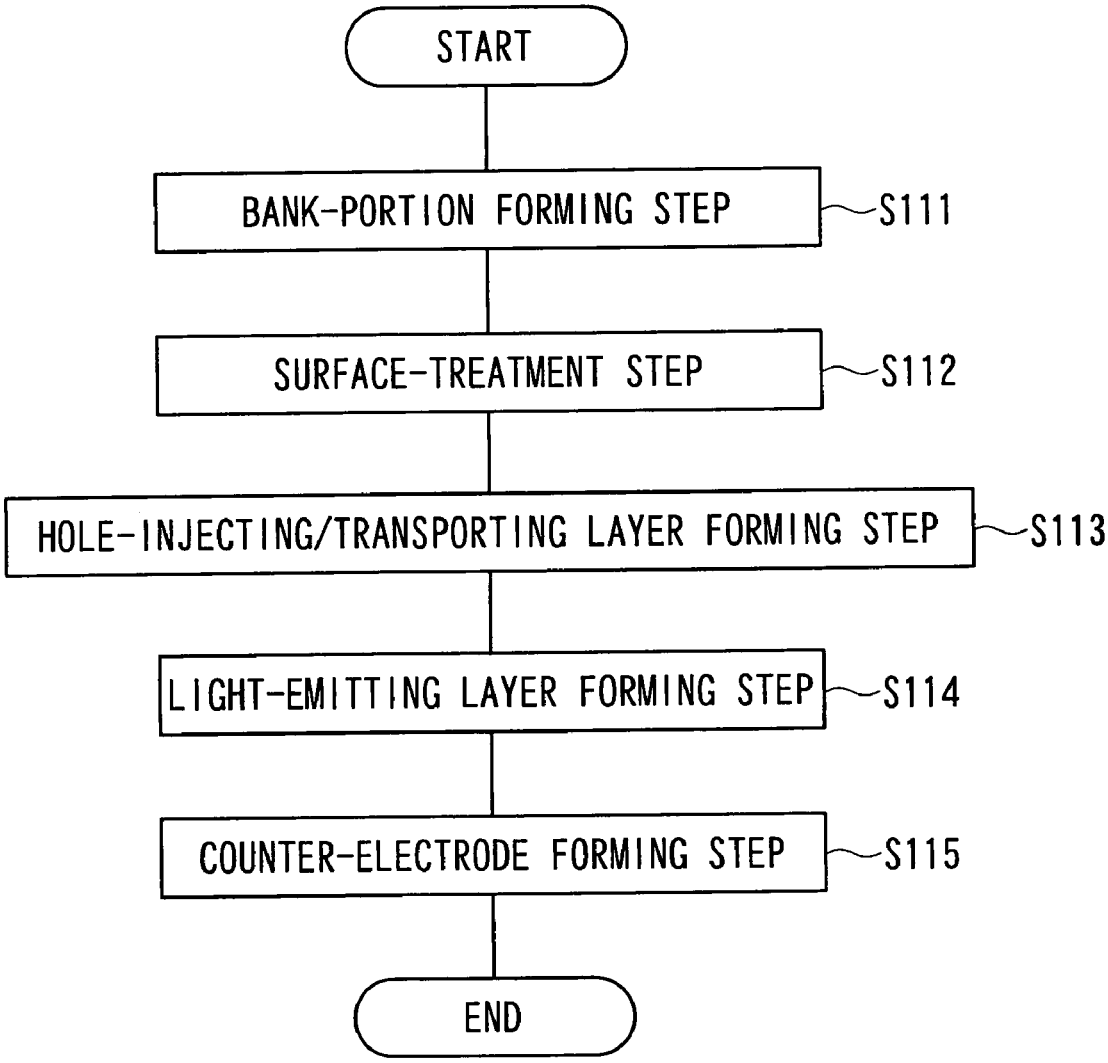
FIG. 15 is a flow chart explaining a step of manufacturing the display device as an organic EL device.

As shown in FIG. 15, the display device 600 is manufactured by way of a bank-portion forming step (S111), a surface-treatment step (S112), a hole-injecting/transporting layer forming step (S113), a light-emitting layer forming step (S114), and an counter-electrode forming step (S115). Note that the manufacturing process is not limited to that exemplified in the figure, and some steps may be deleted from or added to the process as required.

Figure 16:
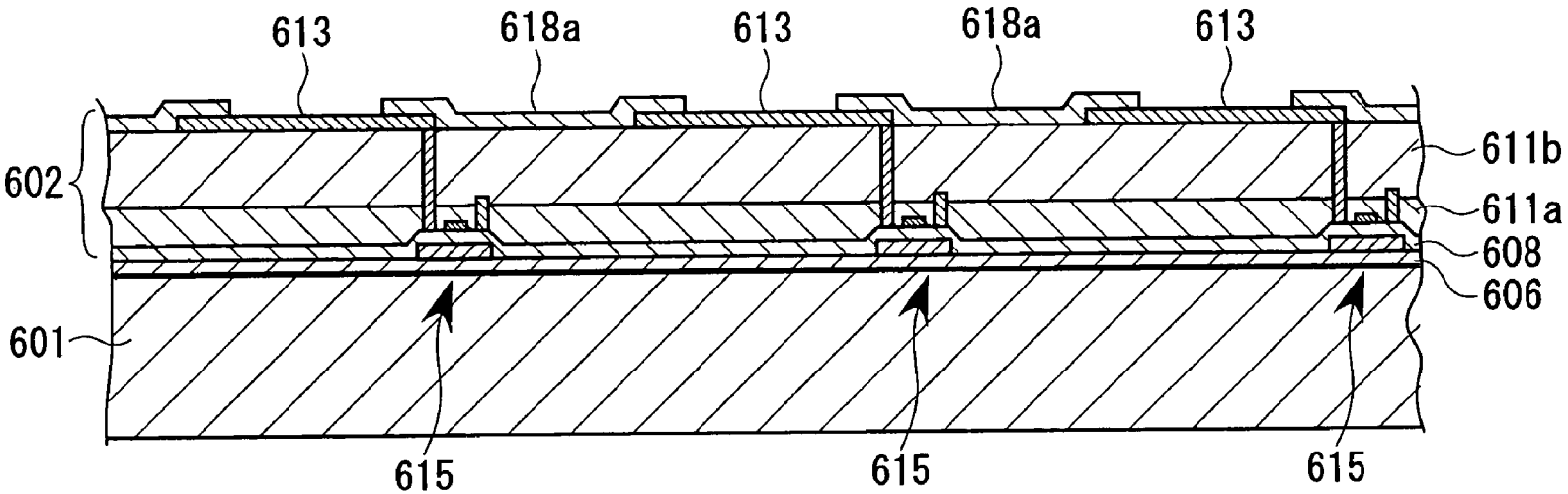
FIG. 16 is a process drawing explaining the formation of an inorganic bank layer.

First, as shown in FIG. 16, the inorganic bank layer 618*a* is formed on the second interlayer insulation film 611*b* in the bank-portion forming step (S111). The inorganic bank layer 618*a* is formed after an inorganic film is formed at its forming position and is then patterned by a photolithographic process or the like. At this time, a part of the inorganic bank layer 618*a* is formed so as to overlap with the periphery of the pixel electrode 613.

Figure 17:
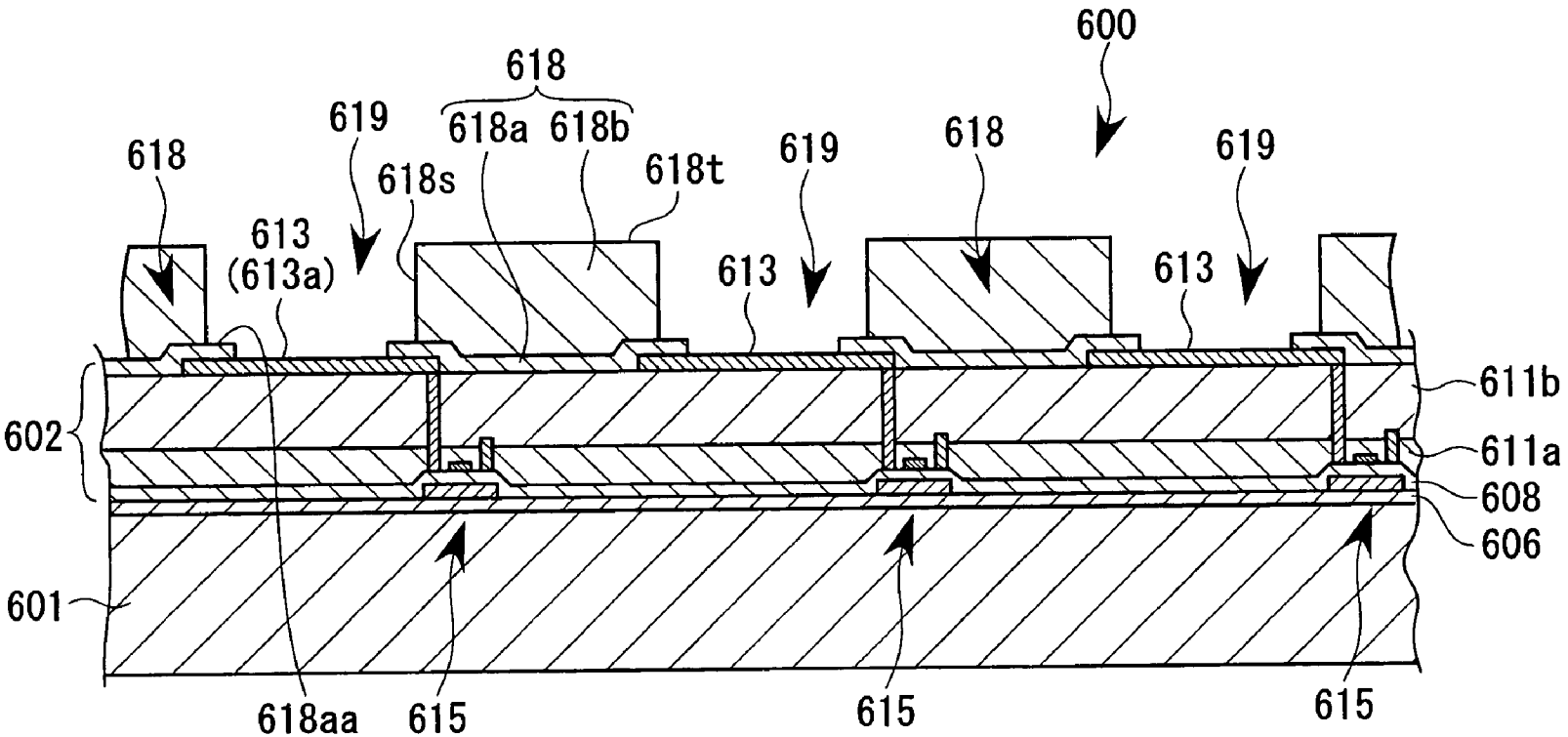
FIG. 17 is a process drawing explaining the formation of an organic bank layer.

After the inorganic bank layer 618*a* is formed, the organic bank layer 618*b* is formed on the inorganic bank layer 618*a* as shown in FIG. 17. The organic bank layer 618*b* is also patterned by the photolithographic process or the like in the same manner as that of the inorganic bank layer 618*a*.

The bank portion 618 is thus formed. In accordance with the formation of the bank, the respective bank portions 618 have the opening portion 619 formed therebetween so as to be opened upward relative to the pixel electrodes 613. The opening portion 619 serves to define a pixel region.

In the surface-treatment step (S112), lyophilic and liquid-repellent treatments are performed. The lyophilic treatment is applied to the regions of a first lamination portion 618*aa* of the inorganic bank layer 618*a* and an electrode surface 613*a* of the pixel electrode 613, and the regions are surface-treated so as to be lyophilic with plasma treatment using, for example, oxygen as a process gas. The plasma treatment serves also to clean ITO constituting the pixel electrode 613.

Furthermore, the liquid-repellent treatment is applied to wall surfaces 618*s* and the top surface 618*t* of the organic bank layer 618*b*, and the surfaces are fluoridized (treated so as to be liquid-repellent) with plasma treatment using, for example, tetrafluoromethane as a process gas.

As a result of the surface treatment step, it is possible to reliably shoot functional liquid droplets into pixel regions when the functional layer 617 is formed with the functional liquid droplet ejection head 17 and prevent the functional liquids shot into the pixel regions from leaking out of the opening portion 619.

According to the above-described steps, a display device substrate 600A can be obtained. The display device substrate 600A is mounted on the set table 21 of the liquid droplet ejection apparatus 1 as shown in FIG. 2, and the following hole-injecting/transporting layer forming step (S113) and the light-emitting layer forming step (S114) are hereinafter performed.

Figure 18:
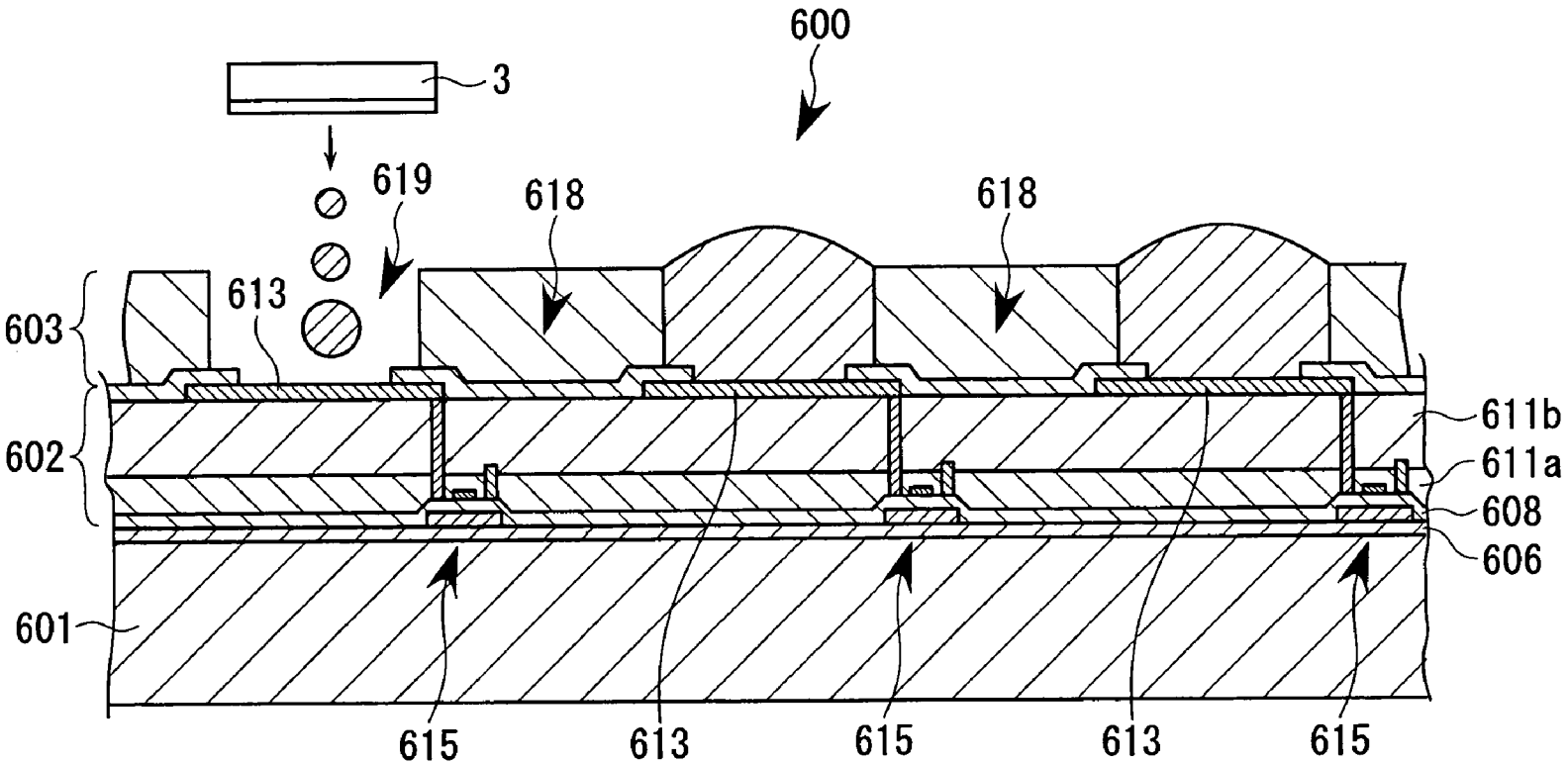
FIG. 18 is a process drawing explaining a step of forming a hole-injecting/transporting layer.
Figure 19:
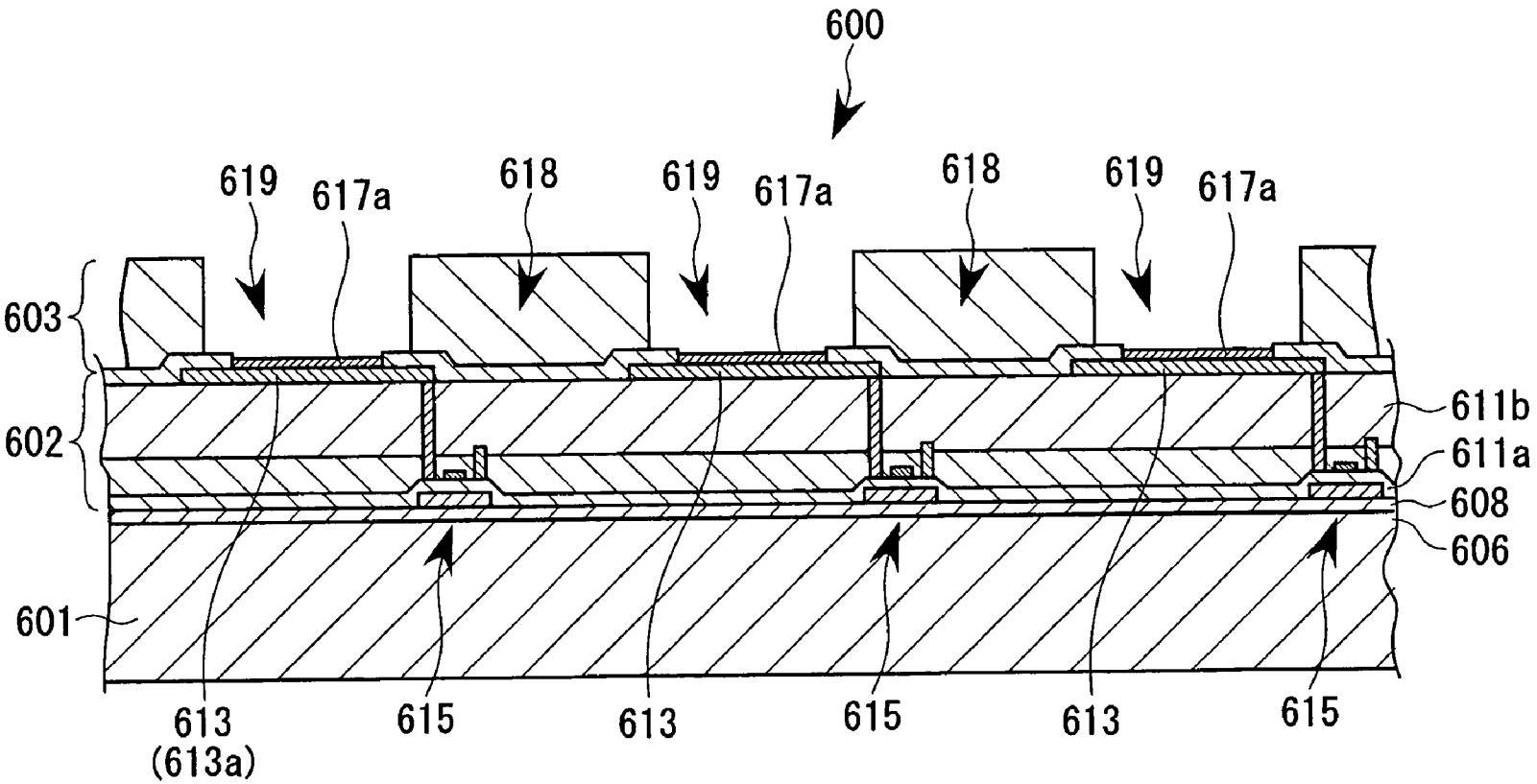
FIG. 19 is a process drawing explaining a state where the hole-injecting/transporting layer is formed.

As shown in FIG. 18, in the hole-injecting/transporting layer forming step (S113), the functional liquid droplet ejection head 17 ejects the first composition containing the hole-injecting/transporting layer forming material in the corresponding opening portion 619 as a pixel region. Subsequently, drying treatment and thermal treatment are performed on the first composition so as to evaporate a polar solvent contained therein and form the hole-injecting/transporting layer 617*a* on the pixel electrode (electrode surface 613*a*) 613 as shown in FIG. 19.

Next, a description will be made about the light-emitting layer forming step (S114). In the light-emitting layer forming step, the nonpolar solvent insoluble to the hole-injecting/transporting layer 617*a* is used as the second composition solvent for use in forming the light-emitting layer so as to prevent the hole-injecting/transporting layer 617*a* from being dissolved again as described above.

On the other hand, however, the hole-injecting/transporting layer 617*a* has a low affinity for the nonpolar solvent. Therefore, even if the second composition containing the nonpolar solvent is ejected on the hole-injecting/transporting layer 617*a*, there is a possibility that the hole-injecting/transporting layer 617*a* cannot be brought into intimate contact with the light-emitting layer 617*b*, or that the light-emitting layer 617*b* cannot be evenly coated.

To enhance the affinity of the surface of the hole-injecting/transporting layer 617*a* with respect to the nonpolar solvent and the light-emitting layer forming material, it is preferable that the surface treatment (surface modification treatment) be performed before the light-emitting layer is formed. In the surface treatment, a surface modification material as a solvent identical with or similar to the nonpolar solvent of the second composition for use in forming the light-emitting layer is coated on the hole-injecting/transporting layer 617*a* and then dried.

Such treatments make it easy for the surface of the hole-injecting/transporting layer 617*a* to soak into the nonpolar solvent, and the second composition containing the light-emitting layer forming material can be evenly coated on the hole-injecting/transporting layer 617*a* in the following steps.

Figure 20:
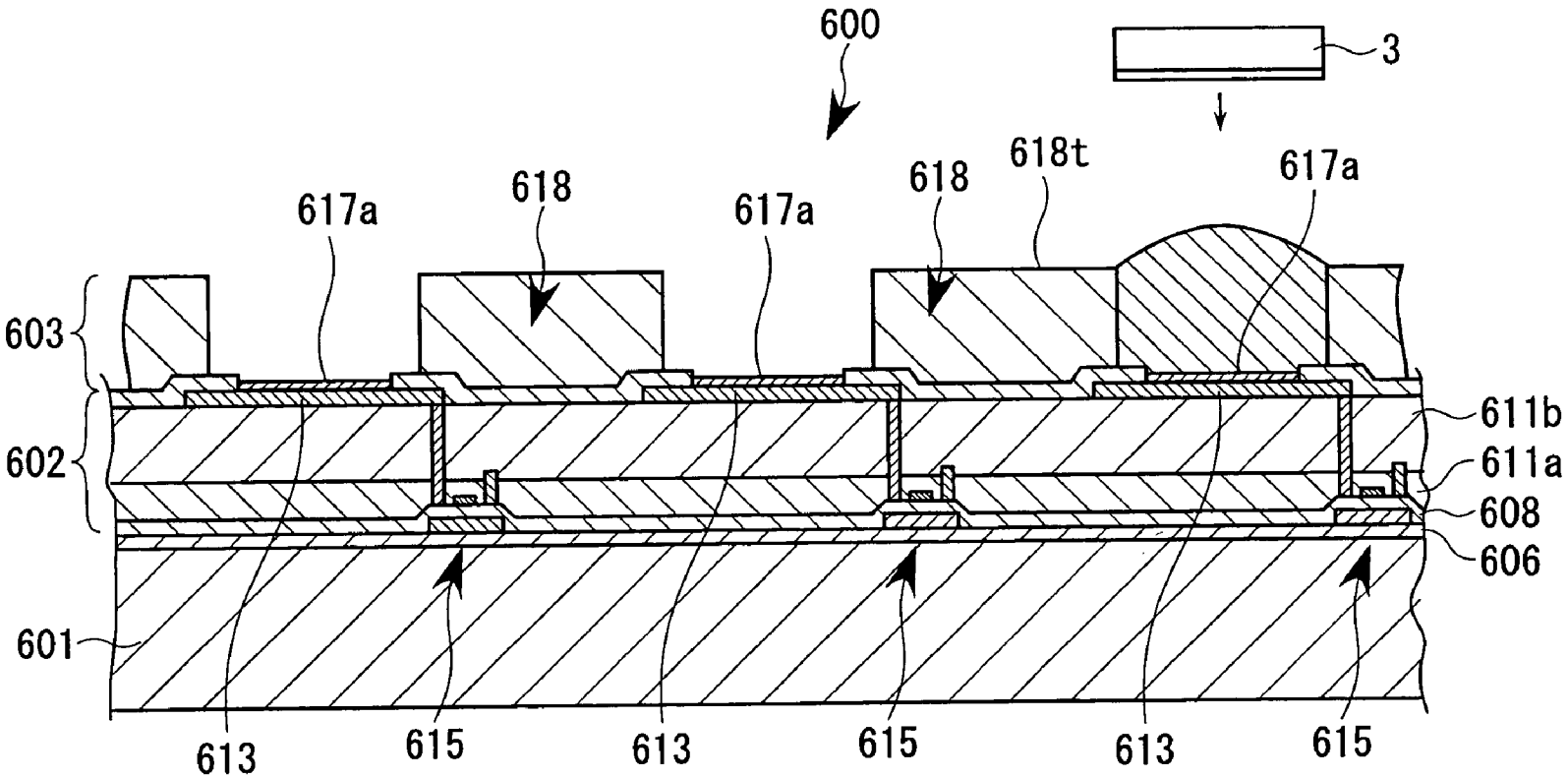
FIG. 20 is a process drawing explaining a step of forming a blue light-emitting layer.

Next, as shown in FIG. 20, a predetermined amount of the second composition containing the light-emitting layer forming material corresponding to any one of the colors (blue (B) in the example of FIG. 20) is implanted in the pixel region (opening portion 619) as a functional liquid droplet. The second composition implanted in the pixel region spreads over the hole-injecting/transporting layer 617*a* and is filled in the opening portion 619. Note that, in case that the second composition is shot on the top surface 618*t* of the bank portion 618 away from the pixel region, it will easily find its way into the opening portion 619 since the liquid-repellent treatment has been previously applied to the top surface 618*t* as described above.

Figure 21:
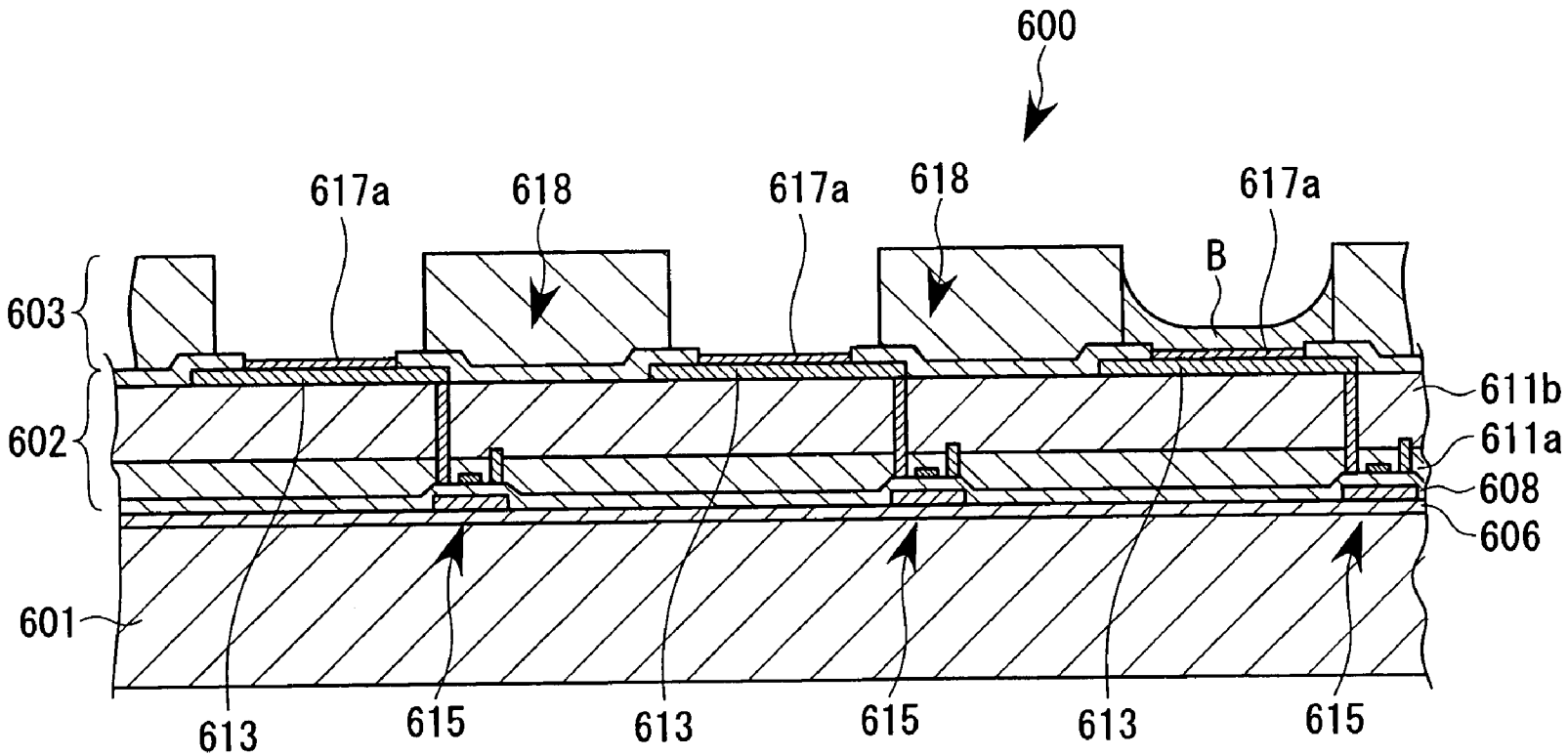
FIG. 21 is a process drawing explaining a state where the blue light-emitting layer is formed.

Subsequently, the second composition ejected is dried through a drying step, etc., making the nonpolar solvent contained in the second composition evaporate, and then forming the light-emitting layer 617*b* on the hole-injecting/transporting layer 617*a* as shown in FIG. 21. In the case of this figure, the light-emitting layer 617*b* corresponding to the blue color (B) is formed.

Figure 22:
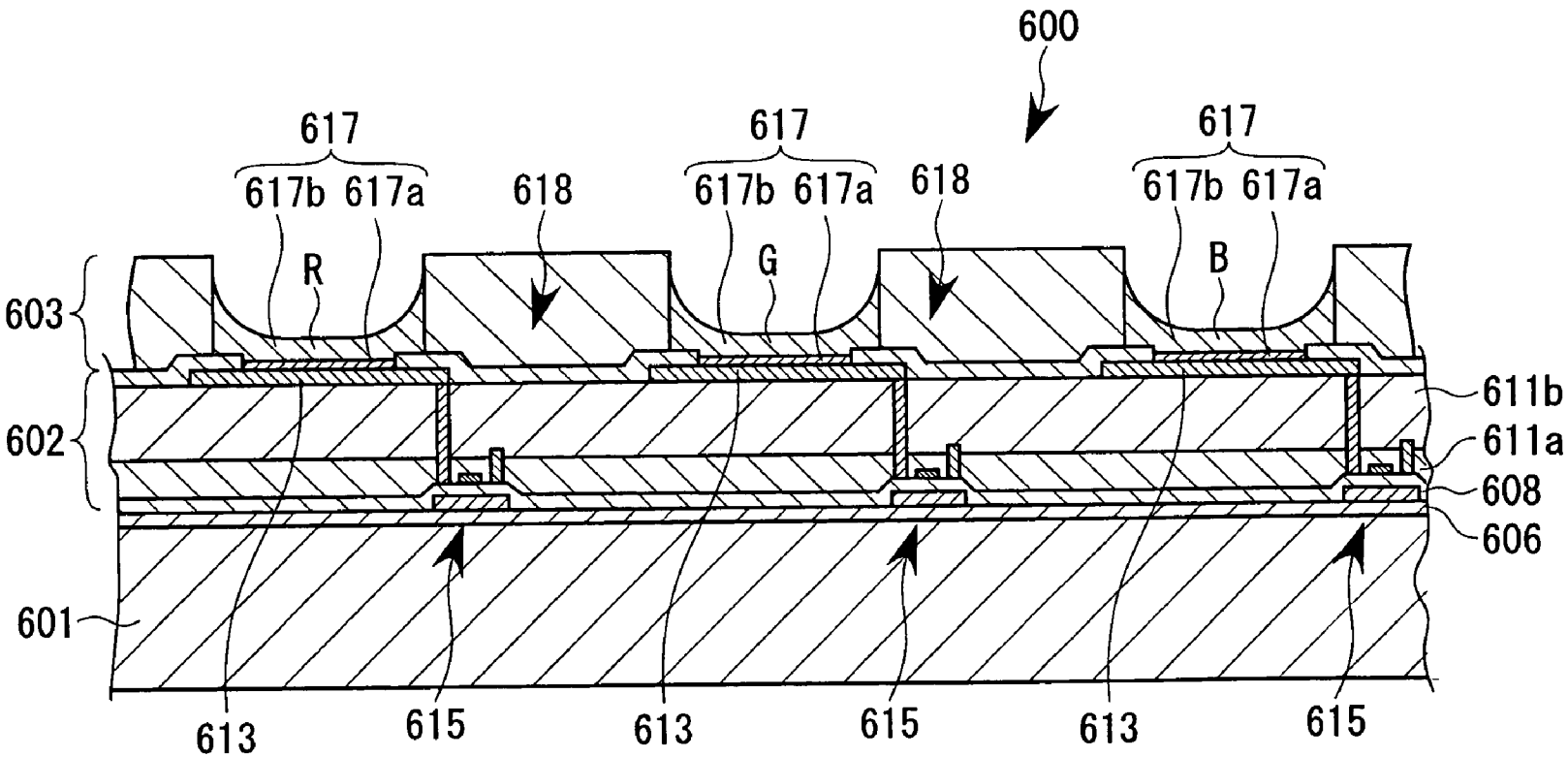
FIG. 22 is a process drawing explaining a state where light-emitting layers of each color are formed.

Similarly, as shown in FIG. 22, steps similar to that of the light-emitting layer 617*b* corresponding to the blue color (B) as described above are sequentially performed with the functional liquid droplet ejection head 17, and the light-emitting layers 617*b* corresponding to the other colors (red (R) and green (G)) are formed. Note that the order of forming the light-emitting layers 617*b* is not limited to the exemplified one, and the light-emitting layers may be formed in any order. For example, the order can be determined in accordance with the light-emitting layer forming material. Furthermore, examples of arrangement patterns for the three colors of R, G, and B include a strip arrangement, a mosaic arrangement, a delta arrangement, or the like.

In the manner as described above, the functional layer 617, namely, the hole-injecting/transporting layer 617*a* and light-emitting layer 617*b* are formed on each of the pixel electrodes 613. Then, the step is moved to the counter-electrode forming step (S115).

Figure 23:
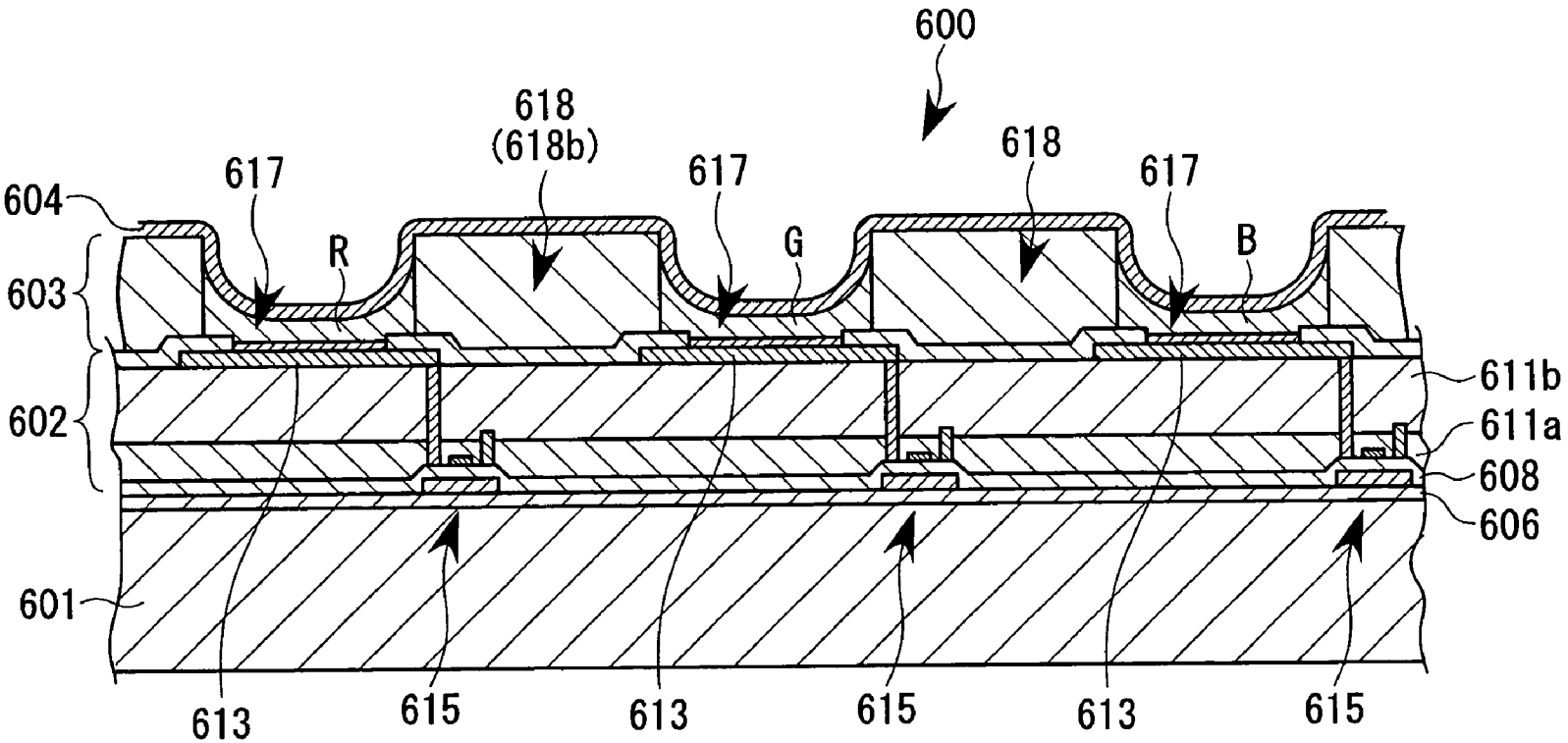
FIG. 23 is a process drawing explaining the formation of a cathode.

In the counter-electrode forming step (S115), as shown in FIG. 23, the cathode 604 (counter electrode) is formed on the whole surfaces of the light-emitting layers 617*b* and the organic bank layers 618*b* by, for example, vapor deposition, spattering, CVD (chemical vapor deposition), or the like. In this embodiment, the cathode 604 has, for example, a calcium layer and an aluminum layer laminated therein.

The cathode 604 has properly disposed thereon an Al film or an Ag film as an electrode and a protection layer made of $SiO_2$, SiN, or the like for preventing the Al film or the Ag film from being oxidized.

After the cathode 604 is thus formed, when other treatments such as sealing treatment for sealing the top portion of the cathode 604 with a sealing member and wiring treatment are applied, the display device 600 is obtained.

Figure 24:
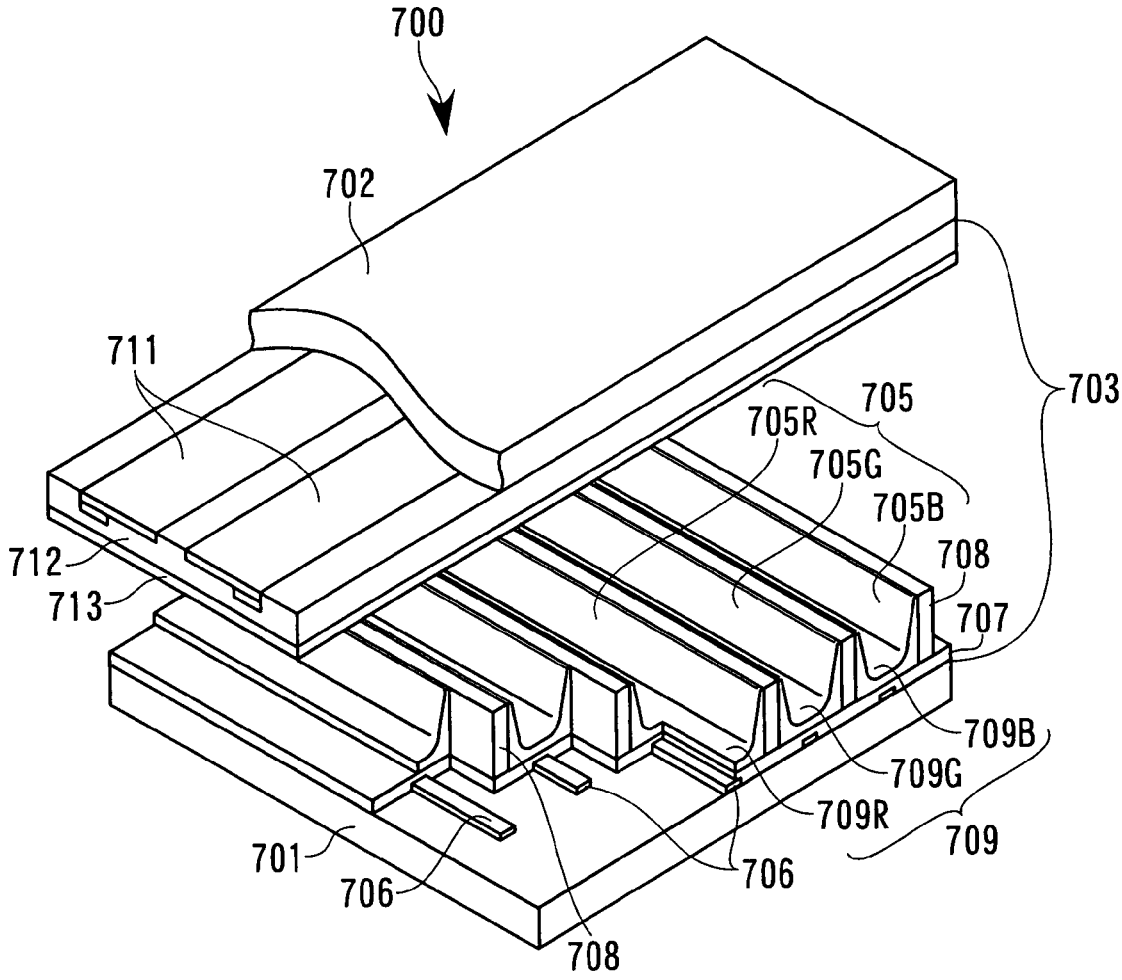
FIG. 24 is an exploded perspective view of an essential part of a display device as a plasma display panel (PDP device).

Next, FIG. 24 is an exploded perspective view of an essential part of a plasma display panel (PDP device: hereinafter, simply referred to as a display device 700). Note that the display device 700 is shown in a state where a part thereof is cut away.

The display device 700 is roughly constituted of mutually opposing first and second substrates 701 and 702 and a discharge display portion 703 held between the first and second substrates. The discharge display portion 703 is composed of a plurality of discharge chambers 705. Of the plurality of discharge chambers 705, a set of three discharge chambers 705 of a red discharge chamber 705R, a green discharge chamber 705G, and a blue discharge chamber 705B is arranged so as to constitute one pixel.

The first substrate 707 has address electrodes 706 formed on the top surface thereof in a stripe pattern at predetermined intervals, and a dielectric layer 707 is formed to cover the top surfaces of the address electrodes 706 and the first substrate 701. The dielectric layer 707 has partition walls 708 projectingly provided thereon, each being arranged between the respective address electrodes 706 and extending along the corresponding address electrodes 706. The partition walls 708 include those extending along the address electrodes 706 as shown in the figure and those (not shown) extending orthogonal to the address electrodes 706.

Areas partitioned by the partition walls 708 serve as the discharge chambers 705.

Each of the discharge chambers 705 has a phosphor 709 arranged therein. The phosphor 709 emits fluorescent light of any one of the colors red (R), green (G), or blue (B). The red, green, and blue discharge chambers 705R, 705G, and 705B have red, green, and blue fluorescent materials 709R, 705G, and 705B arranged at the bottom portions thereof, respectively.

The second substrate 702 has a plurality of display electrodes 711 formed on the bottom surface thereof, as shown in the figure, so as to extend in the direction orthogonal to the address electrodes 706 in a stripe pattern at predetermined intervals. To cover the display electrodes, a dielectric layer 712 and a protection film 713 made of MgO or the like are formed.

The first substrate 701 and the second substrate 702 are bonded to each other in a state where the address electrodes 706 and the display electrodes 711 lie orthogonal to each other. Note that the address electrodes 706 and the display electrodes 711 are connected to respective alternators (not shown).

When each of the electrodes 706 and 711 is energized, the phosphors 709 are excited to emit light in the discharge display portion 703, thereby providing color display.

According to this embodiment, the address electrodes 706, the display electrodes 711, and the phosphors 709 can be formed with the liquid droplet ejection apparatus 1 as described in FIG. 2. Hereinafter, a description will be made about a step of forming the address electrodes 706 of the first substrate 701.

In this case, the following step is performed in a state where the first substrate 701 is mounted on the set table 21 of the liquid droplet ejection apparatus 1.

First, a liquid material (functional liquid) containing a material for forming a conductive-film wiring is, as a functional liquid droplet, shot into a region of forming an address electrode with the functional liquid droplet ejection heads 17. The liquid material contains conductive fine particles made of a metal or the like, dispersed into a disperse medium, as a material for forming a conductive-film wiring. As the conductive fine particles, metal fine particles containing, for example, gold, silver, copper, palladium, nickel, and a conductive polymer or the like are used.

When replenishment of the liquid material in the whole region of forming address electrodes to be objected is finished, the ejected liquid material is subjected to drying treatment and the disperse medium contained in the liquid material is evaporated, thereby forming the address electrodes 706.

Meanwhile, as the address electrodes 706 are formed in the above, the display electrodes 711 and the phosphors 709 can also be formed by way of each of the above-described steps.

To form the display electrodes 711, a liquid material (functional liquid) containing a material for forming a conductive film wiring is, as a functional liquid droplet, shot into a region of forming a display electrode in the same manner as that of the address electrodes 706.

To form the phosphors 709, a liquid material (functional liquid) containing a luminescent material corresponding to each of the colors, R, G, and B, is ejected from the functional liquid droplet ejection heads 17 and shot into the discharge chambers 705 of the corresponding colors.

Figure 25:
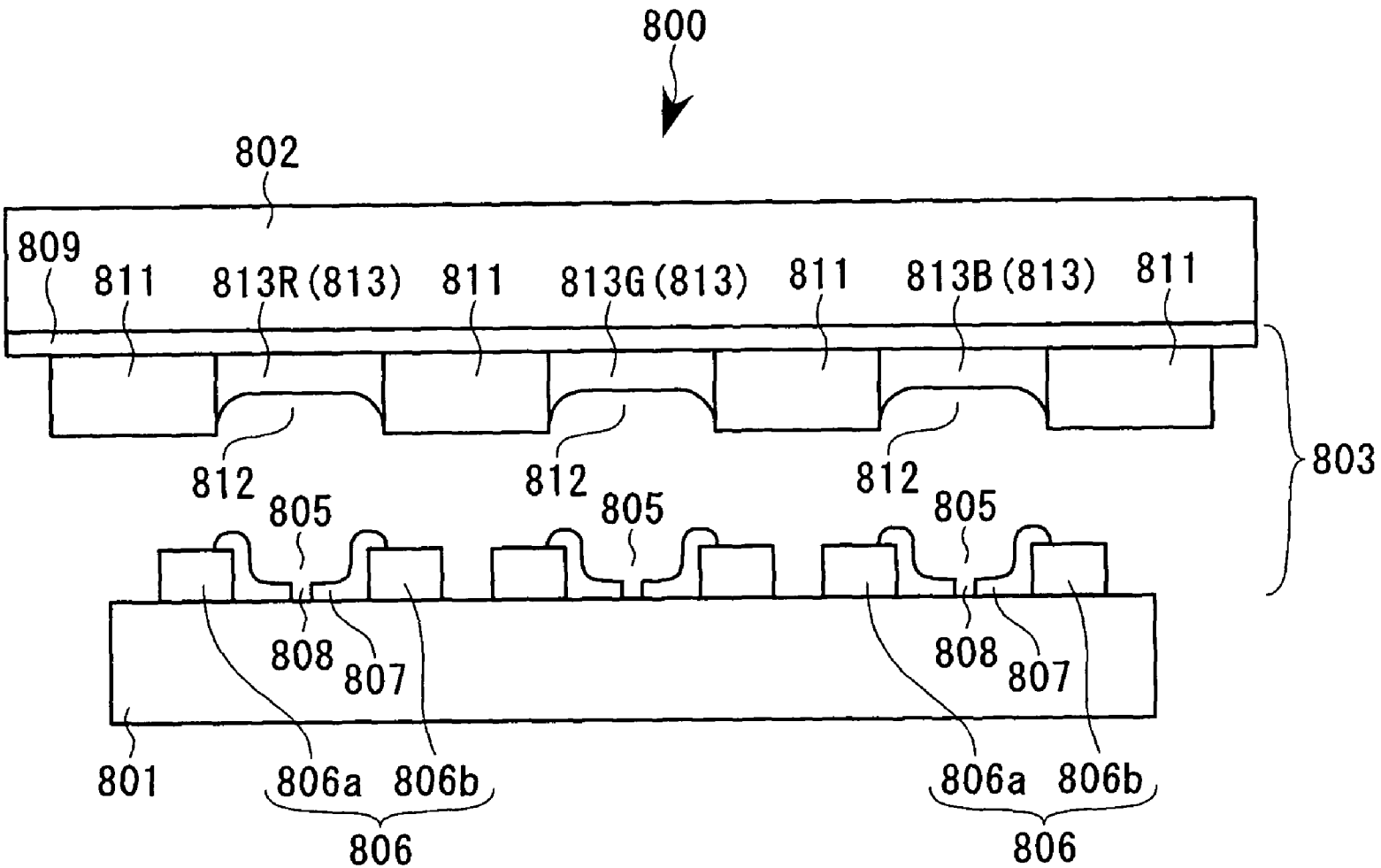
FIG. 25 is a cross section of an essential part of a display device as an electron emission device (FED device).

FIG. 25 is a cross section of an essential part of an electron emission device (also called FED or SED, hereinafter simply referred to as a display device 800). Note that, in the figure, the display device 800 is in a state where a part thereof is shown in cross section.

The display device 800 is roughly constituted of mutually opposing first and second substrates 801 and 802, and a field-emission display portion 703 held between the first and second substrates. The field-emission display portion 803 is composed of a plurality of electron-emitting portions 805 arranged in a matrix pattern.

The first substrate 801 has first and second element electrodes 806*a* and 806*b* constituting cathode electrodes 806 formed on the top surface thereof so as to be mutually orthogonal to each other. Furthermore, in a part partitioned by each of the first and second element electrodes 806*a* and 806*b*, a conductive film 807 having a gap formed therein is formed. In other words, the first element electrodes 806*a*, the second element electrodes 806*b*, and the conductive films 807*c* constitute the plurality of electron-emitting portion 805. Each of the conductive films 807 is made of palladium oxide (PdO) or the like, and the gap 808 is formed, for example, by means of foaming after the conductive film 807 is formed.

The second substrate 802 has anode electrodes 809 formed on the bottom surface thereof so as to oppose the cathode electrodes 806. Each of the anode electrodes 809 has bank portions 811 formed in a lattice pattern on the bottom surface thereof. In each of opening portions 812 oriented downward surrounded by the bank portions 811, phosphors 813 are arranged so as to correspond to the electron-emitting portions 805. The phosphors 813 emit fluorescent light of any one of the colors red (R), green (G), or blue (B). In each of the opening portions 812, red, green, and blue fluorescent materials 813R, 813G, and 813B are arranged in the above-described predetermined pattern.

The first substrate 801 and the second substrate 802 thus formed are bonded to each other so as to have a small gap therebetween. In the display device 800, an electron emitted from the first element electrodes 806*a* or the second element electrodes 806*b* as a cathode hits upon the phosphor 813 formed on the anode electrode 809 as an anode via the conductive film (gap 808) 807 so as to be excited to emit light, thereby providing color display.

In the same manner as those of other embodiments, the first element electrodes 806*a*, the second element electrodes 806*b*, the conductive films 807, and the anode electrodes 809 can be formed with the liquid droplet ejection apparatus 1, and the phosphors 813R, 813G, 813B corresponding to each of the colors can be formed with the liquid droplet ejection apparatus 1.

Figure 26A:
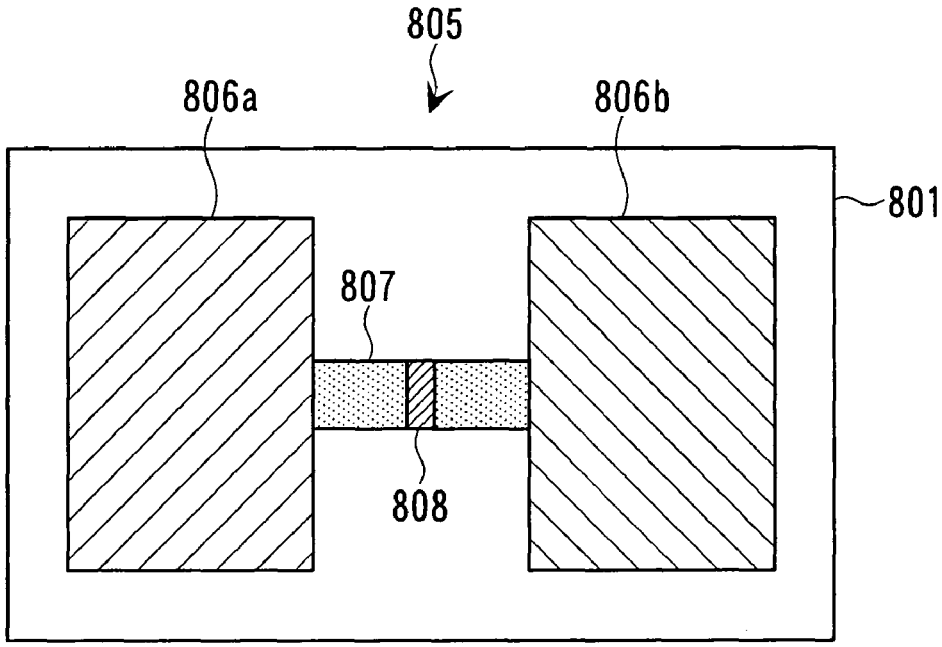
FIGS. 26A and 26B are plan views, each showing an electron-emitting portion and its surrounding components of the display device and a method of forming thereof.
Figure 26B:
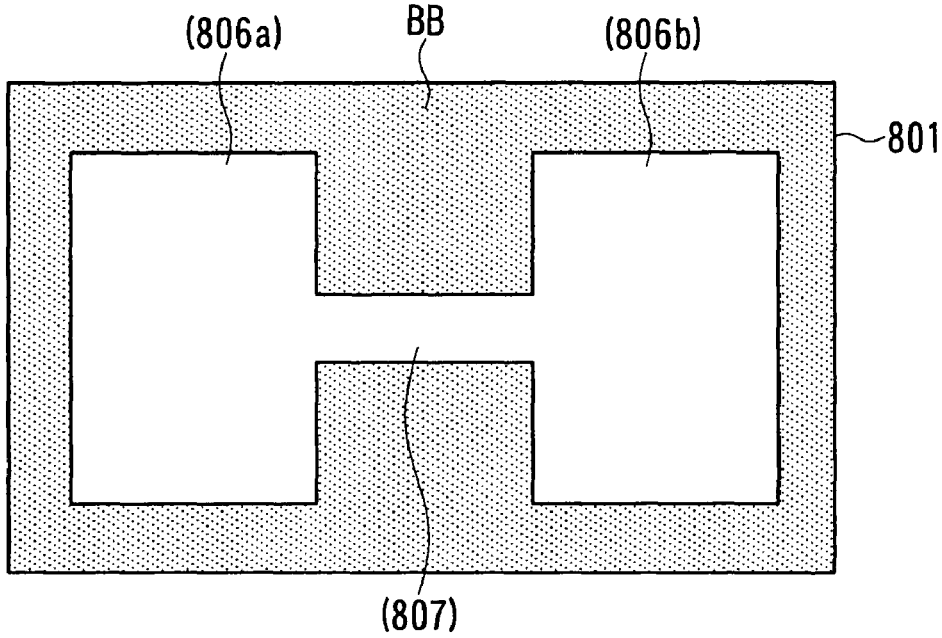

The first element electrode 806*a*, the second element electrode 806*b*, and the conductive film 807 are formed in a plan shape as shown in FIG. 26A. To deposit the first element electrode, the second element electrode, and the conductive film, a bank portion BB is formed (by means of photolithography process), while a portion where the first element electrode 806*a*, the second element electrode 806*b*, and the conductive film 807 are to be formed is left intact. Next, the first element electrode 806*a* and the second element electrode 806*b* are formed (by an ink-jet method of the liquid droplet ejection apparatus 1) in a groove portion composed of the bank portion BB, the solvent used therefor is dried to deposit the above components, and then the conductive film 807 is formed (by an ink-jet method of the liquid droplet ejection apparatus 1). After the conductive film 807 is deposited, the bank portion BB is removed (by an ashing process), and then the above-described forming process is performed. Note that, in the same manner as the organic EL device as described above, it is preferable that the first and second substrates 801 and 802 and the bank portion 811 and BB be subjected to lyophilic treatment and liquid-repellent treatment, respectively.

Furthermore, examples of electro-optic devices include devices for forming metal wiring, lens, resist, light diffuser, or the like. Various electro-optic devices can efficiently be manufactured when the above-described liquid droplet ejection apparatus 1 is applied for manufacturing the same.

What is claimed is:

1. An ejection inspection device provided in a liquid droplet ejection apparatus having an imaging device which drives a functional liquid droplet ejection head to eject functional liquid so as to perform an imaging process on a workpiece while relatively moving the functional liquid droplet ejection head, the ejection inspection device being used to inspect ejection failures of the functional liquid droplet ejection head and comprising:

an inspection sheet which is formed in a strip shape and receives an inspecting ejection from the functional liquid droplet ejection head;

an inspection stage on which the inspection sheet is sucked and mounted and which communicates with a vacuum suction unit for sucking the inspection sheet and with an air supply unit for floating the inspection sheet;

a sheet feeding mechanism which is disposed on one end side of the inspection stage and feeds the inspection sheet wound in a roll form onto the inspection stage;

a sheet taking-up mechanism which is disposed on the other end side of the inspection stage and takes up the fed inspection sheet from the inspection stage;

a suction air valve unit which is interposed between the inspection stage and the vacuum suction unit and controls the suction air of the inspection stage;

a floating air valve unit which is interposed between the inspection stage and the air supply unit and controls the floating air of the inspection stage; and a control unit which controls the suction air valve unit, the floating air valve unit, the sheet feeding mechanism, and the sheet taking-up mechanism, wherein the control unit floats the inspection sheet for performing the feeding operation of the inspection sheet and the taking-up operation thereof and alternately sucks the inspection sheet first from the other end side of the inspection stage and then from the one end side of the inspection stage.

2. The ejection inspection device according to claim 1, wherein the inspection stage includes:

a porous plate on which the inspection sheet is sucked and mounted;

a frame on which the porous plate is horizontally held;

an air chamber which is formed inside the frame facing the bottom surface of the porous plate and communicates with the vacuum suction unit and the air supply unit.

3. The ejection inspection device according to claim 2, wherein the frame and the porous plate are conductive.

4. The ejection inspection device according to claim 1, wherein the sheet feeding mechanism and the sheet taking-up mechanism each have a driving source, and the control unit simultaneously drives the sheet feeding mechanism and the sheet taking-up mechanism to perform the feeding operation and the taking-up operation.

5. The ejection inspection device according to claim 1, wherein the inspection stage is composed of a plurality of divided stages divided into the extending direction of the inspection sheet, the suction air valve unit is configured to be capable of individually controlling the suction air of the plurality of divided stages, and the floating air valve unit is configured to be capable of individually controlling the floating air of the plurality of divided stages.

6. The ejection inspection device according to claim 5, wherein the control unit controls the suction air valve unit for sucking the inspection sheet and makes the plurality of divided stages perform a sucking operation alternately from the divided stage positioned at one end to that positioned at the other end.

7. The ejection inspection device according to claim 6, wherein, for sucking the inspection sheet, the control unit drives the sheet feeding mechanism slightly in the reverse-feed direction so as to give a tension to the inspection sheet when the sheet feeding mechanism is positioned on the other end side, and drives the sheet taking-up mechanism slightly in the forward-feed direction so as to give a tension to the inspection sheet when the sheet taking-up mechanism is positioned on the other end side.

8. The ejection inspection device according to claim 5, wherein the control unit controls the suction air valve unit for sucking the inspection sheet and makes the plurality of divided stages perform a sucking operation alternately from the divided stage positioned at the intermediate part to those positioned at both ends.

9. The ejection inspection device according to claim 8, wherein, for sucking the inspection sheet, the control unit drives the sheet feeding mechanism slightly in the reverse-feed direction and drives the sheet taking-up mechanism slightly in the forward-feed direction so as to give a tension to the inspection sheet.

10. The ejection inspection device according to claim 5, wherein a divided air chamber of the respective divided stages is composed of a plurality of segmentalized air chambers, the plurality of segmentalized air chambers are each connected with a suction air passage communicating with the suction air valve unit and a floating air passage communicating with the floating air valve unit, the suction air valve unit is configured to be capable of individually controlling the suction air of the plurality of segmentalized air chambers, and the floating air valve unit is configured to be capable of individually controlling the floating air of the plurality of segmentalized air chambers.

11. The ejection inspection device according to claim 1, wherein the control unit drives the sheet taking-up mechanism slightly in the forward-feed direction so as to give a tension to the inspection sheet.

12. An ejection inspection device provided in a liquid droplet ejection apparatus having an imaging device which drives a functional liquid droplet ejection head to eject functional liquid so as to perform an imaging process on a workpiece while relatively moving the functional liquid droplet ejection head, the ejection inspection device being used to inspect ejection failures of the functional liquid droplet ejection head and comprising:

an inspection sheet which is formed in a strip shape and receives an inspecting ejection from the functional liquid droplet ejection head;

an inspection stage on which the inspection sheet is sucked and mounted and which communicates with a vacuum suction unit for sucking the inspection sheet and with an air supply unit for floating the inspection sheet;

a sheet feeding mechanism which is disposed on one end side of the inspection stage and feeds the inspection sheet wound in a roll form onto the inspection stage;

a sheet taking-up mechanism which is disposed on the other end side of the inspection stage and takes up the fed inspection sheet from the inspection stage;

a suction air valve unit which is interposed between the inspection stage and the vacuum suction unit and controls the suction air of the inspection stage;

a floating air valve unit which is interposed between the inspection stage and the air supply unit and controls the floating air of the inspection stage; and a control unit which controls the suction air valve unit, the floating air valve unit, the sheet feeding mechanism, and the sheet taking-up mechanism, wherein the control unit floats the inspection sheet for performing the feeding operation of the inspection sheet and the taking-up operation thereof and alternately sucks the inspection sheet first from the one end side of the inspection stage and then from the other end side of the inspection stage.

13. The ejection inspection device according to claim 12, wherein the control unit drives the sheet taking-up mechanism slightly in the forward-feed direction so as to give a tension to the inspection sheet.

14. An ejection inspection device provided in a liquid droplet ejection apparatus having an imaging device which drives a functional liquid droplet ejection head to eject functional liquid so as to perform an imaging process on a workpiece while relatively moving the functional liquid droplet ejection head, the ejection inspection device being used to inspect ejection failures of the functional liquid droplet ejection head and comprising:

an inspection sheet which is formed in a strip shape and receives an inspecting ejection from the functional liquid droplet ejection head;

an inspection stage on which the inspection sheet is sucked and mounted and which communicates with a vacuum suction unit for sucking the inspection sheet and with an air supply unit for floating the inspection sheet;

a sheet feeding mechanism which is disposed on one end side of the inspection stage and feeds the inspection sheet wound in a roll form onto the inspection stage;

a sheet taking-up mechanism which is disposed on the other end side of the inspection stage and takes up the fed inspection sheet from the inspection stage;

a suction air valve unit which is interposed between the inspection stage and the vacuum suction unit and controls the suction air of the inspection stage;

a floating air valve unit which is interposed between the inspection stage and the air supply unit and controls the floating air of the inspection stage; and a control unit which controls the suction air valve unit, the floating air valve unit, the sheet feeding mechanism, and the sheet taking-up mechanism, wherein the control unit floats the inspection sheet for performing the feeding operation of the inspection sheet and the taking-up operation thereof and alternately sucks the inspection sheet first from an intermediate part of the inspection stage and then from both the one end and the other end of the inspection stage while driving the sheet feeding mechanism slightly in the reverse-feed direction and driving the sheet taking-up mechanism slightly in the forward-feed direction so as to give a tension to the inspection sheet.

* * * * *